US006599689B2

(12) United States Patent
Tamaoki et al.

(10) Patent No.: US 6,599,689 B2
(45) Date of Patent: Jul. 29, 2003

(54) SILVER HALIDE COLOR NEGATIVE PHOTOGRAPHIC LIGHTSENSITIVE MATERIAL AND IMAGE PROCESSING METHOD USING THE SAME

(75) Inventors: Hiroshi Tamaoki, Minami-Ashigara (JP); Yasushi Nozawa, Minami-Ashigara (JP); Keisuke Matsumoto, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/123,190

(22) Filed: Apr. 17, 2002

(65) Prior Publication Data

US 2003/0104323 A1 Jun. 5, 2003

(30) Foreign Application Priority Data

Apr. 18, 2001 (JP) ..... 2001-119951

(51) Int. Cl.[7] ..... G03C 1/46
(52) U.S. Cl. ..... 430/543; 430/503; 430/504
(58) Field of Search ..... 430/543, 503, 430/504

(56) References Cited

U.S. PATENT DOCUMENTS 6,146,818 A 11/2000 Gonzalez et al.

FOREIGN PATENT DOCUMENTS

EP 0 566 077 * 10/1993

* cited by examiner

*Primary Examiner*—Hoa Van Le
(74) *Attorney, Agent, or Firm*—Sughrue Mion, PLLC

(57) ABSTRACT

A silver halide color negative photographic lightsensitive material comprises, on a support, at least one blue-sensitive silver halide emulsion layer, at least one green-sensitive silver halide emulsion layer and at least one red-sensitive silver halide emulsion layer. The total coating amount of colored couplers in the lightsensitive material is less than 0.05 mMol/m$^2$. The lightsensitive material contains at least one spectrally sensitized silver halide emulsion and a compound capable of absorbing light within the spectrally sensitizing region of the spectrally sensitized silver halide emulsion, and capable of reducing the sensitivity of the spectrally sensitized silver halide emulsion by at least 0.05 LogE.

20 Claims, 1 Drawing Sheet

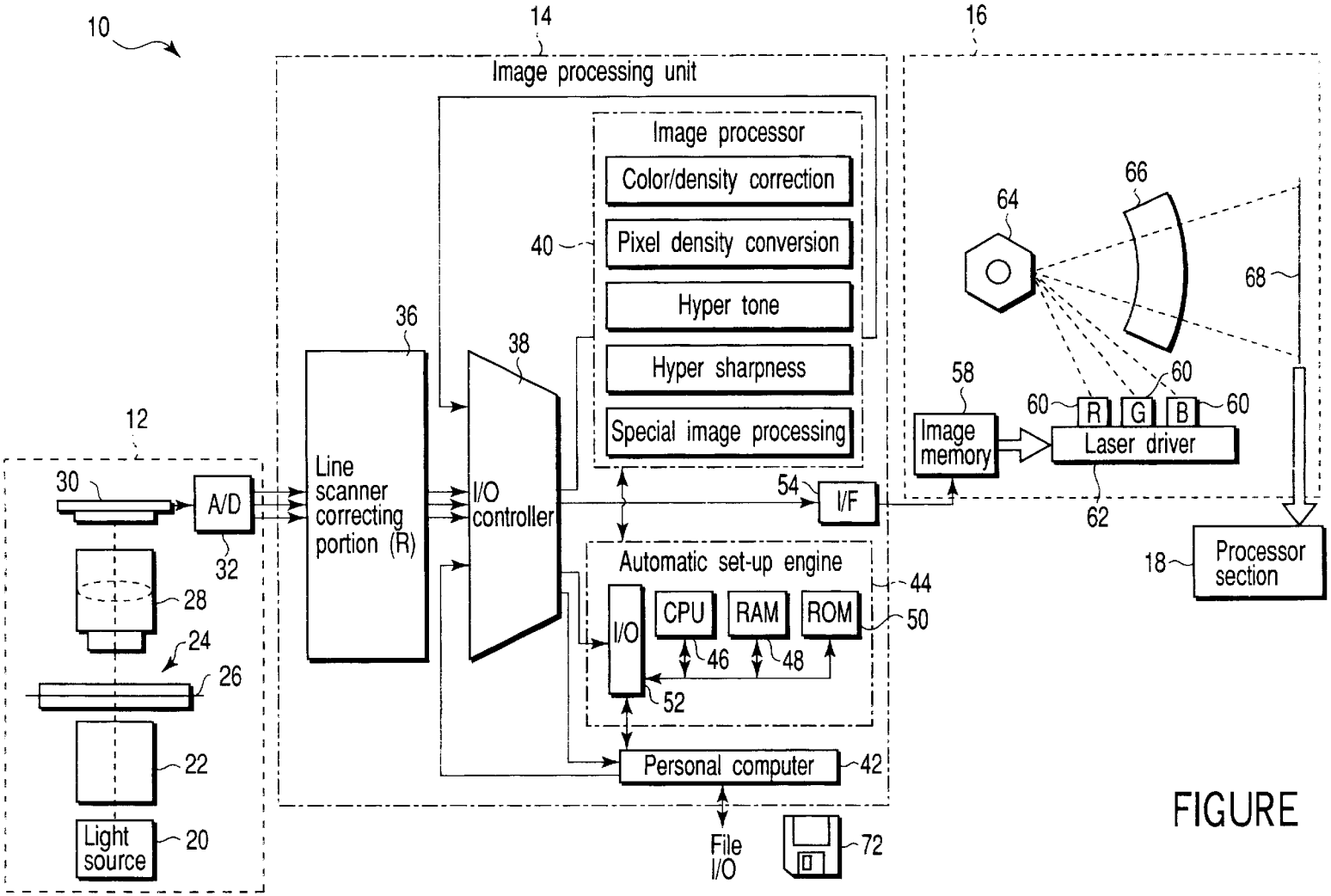
FIGURE

SILVER HALIDE COLOR NEGATIVE PHOTOGRAPHIC LIGHTSENSITIVE MATERIAL AND IMAGE PROCESSING METHOD USING THE SAME

CROSS-REFERENCE TO RELATED APPLICATIONS

This application is based upon and claims the benefit of priority from the prior Japanese Patent Application No. 2001-119951, filed Apr. 18, 2001, the entire contents of which are incorporated herein by reference.

BACKGROUND OF THE INVENTION

1. Field of the Invention

The present invention relates to a color negative photographic lightsensitive material substantially free from colored masking couplers. The purpose of the present invention is to provide a lightsensitive material that is suitable for digital scanning because it is substantially free from colored masking couplers. Especially, the present invention provides a light-sensitive material improved in sharpness, which is a drawback of lightsensitive materials free from colored couplers.

2. Description of the Related Art

With recent progress and spread of digital technology typified by personal computers as background, merits and necessity of converting images into digital files have increased rapidly. On the other hand, despite great improvements in technologies of digital still cameras and digital video cameras, it is difficult to ignore the advantages of silver halide photographs including high speed, wide latitude and improved infrastructure for them and, therefore, a method for obtaining a high-quality digital image file easily from a silver salt photographing material is awaited.

EP No. 1016911 (Jpn. Pat. Appln. KOKAI Publication No. (hereinafter referred to as JP-A-) 11-174637) discloses an attempt to provide a lightsensitive material suitable for a digitization process, for example, an attempt to reduce reading load for a scanner by making a lightsensitive material have a composition substantially free from magenta colored Couplers and the like.

However, such lightsensitive materials substantially free from colored couplers have been found to be inferior to conventional lightsensitive materials in sharpness. Many people thought to be able to secure sharpness to some extent by image processing, such as "unsharp mask," conducted after digitization. However, in fact, such processing necessarily has side effects (other deterioration of image quality) such as deterioration of graininess and unnatural finish, and the quality of prints obtained using such an improved lightsensitive material falls short of that of prints photographed using a lightsensitive material containing colored couplers with good sharpness.

Further, it is very important to manufacture products of the same performance with stability. Products are always required to exhibit only a small change in performance with external disturbance for production (for example, measurement fluctuations, temperature fluctuations and preparation time fluctuations).

BRIEF SUMMARY OF THE INVENTION

An object of the present invention is to eliminate the above-mentioned drawback of the lightsensitive materials substantially free from colored couplers, that is, the deterioration of sharpness and to provide a silver halide color negative photographic lightsensitive material superior in production stability.

Another object of the present invention is to provide an image processing method using the above silver halide color negative photographic lightsensitive material.

The above objects were attained using the following silver halide color negative photographic lightsensitive materials and image processing methods.

(1) A silver halide color negative photographic lightsensitive material comprising, on a support, at least one blue-sensitive silver halide emulsion layer, at least one green-sensitive silver halide emulsion layer and at least one red-sensitive silver halide emulsion layer, wherein the total coating amount of colored couplers in the light-sensitive material is less than 0.05 mMol/$m^2$, and the lightsensitive material contains at least one spectrally sensitized silver halide emulsion and a compound capable of absorbing light within the spectrally sensitizing region of the spectrally sensitized silver halide emulsion, and capable of reducing the sensitivity of the spectrally sensitized silver halide emulsion by at least 0.05 LogE.

(2) The silver halide color negative photographic light-sensitive material recited in item (1) above, wherein the compound is capable of reducing the sensitivity of the spectrally sensitized silver halide emulsion by at least 0.10 LogE.

(3) The silver halide color negative photographic light-sensitive material recited in item (1) or (2) above, wherein the coating amount of the colored couplers is less than 0.02 mMol/$m^2$.

(4) The silver halide color negative photographic light-sensitive material recited in any one of items (1) to (3) above, wherein the compound is capable of flowing out of the lightsensitive material during development process of the lightsensitive material.

(5) The silver halide color negative photographic light-sensitive material recited in any one of items (1) to (3) above, wherein the compound is capable of changing, during the development process of the lightsensitive material, into a compound absorbing substantially no light within the spectrally sensitizing region of the spectrally sensitized silver halide emulsion.

(6) An image processing method comprising: reading image information signals after developing the silver halide color negative photographic light-sensitive material recited in any one of items (1) to (5) above, and regulating the image information signals to output an image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The single FIGURE shows an embodiment of an image processing system according to the present invention.

DETAILED DESCRIPTION OF THE INVENTION

The term "color negative photographic lightsensitive material" used in the present invention designates such a lightsensitive material that an image resulting from a development process is a negative/positive-reversed color image. When a color negative photographic lightsensitive material is used as a lightsensitive material for photographing, it cannot be appreciated as it is. There is a necessity of printing on a color paper or observing with CRT after electrical conversion.

On the other hand, because a color negative photographic lightsensitive material itself is not observed directly, it has some merits, e.g., securing wide latitude. One of the important merits is that no problem will arise even if an unexposed portion of a lightsensitive material after a development process has a "color". Therefore, colored functional materials such as colored couplers described later can be used. Colored functional materials never can be used in lightsensitive materials to be observed as it is because white has to look white.

Incidentally, with the recent progress in computer technology and the like, digitization of images has been required. Merits of digitization of images include:

(1) conversion of images into digital data makes image processing or the like easy; and (2) use of digital printers stabilizes and improves print quality.

A general way for digitizing an image resulting from the development of a photographic lightsensitive material is a method of reading the image by digital scanning using a scanner. Concrete examples of this method include the following embodiment.

The single Figure shows an image processing system 10 to which the present invention may be applied. The image processing system 10 has a structure in which a film scanner 12, an image processing unit 14 and a printer 16 are connected in series.

The film scanner 12 is a device that reads a film image recorded on a color negative photographic material 26 (a negative image that has been visualized through development after photographing of an object) and outputs the image data obtained through the reading. The device is structured so that a light emitted from a light source 20 and having an unevenness in the quantity of light reduced by a light diffusion box 22 is irradiated to the color negative photographic lightsensitive material 26 set in a film carrier 24 and the light passed through the color negative photographic lightsensitive material 26 is focused on a light receiving surface of a line CCD sensor 30 (it may be an area CCD sensor) through a lens 28.

The film carrier 24 conveys the color negative photographic lightsensitive material 26 so that portions of the color negative photographic lightsensitive material 26 having film images recorded are positioned in turn on an optical axis of the emitted light from the light source 20. If the color negative photographic lightsensitive material 26 is conveyed, the film images recorded on the light-sensitive material 26 are read in succession by the CCD sensor 30 and the signals corresponding to the film images are outputted from the CCD sensor 30. The signals outputted from the CCD sensor 30 are converted into digital image data by an A/D converter 32 and then inputted to an image processing unit 14.

A line scanner correction section 36 of the image processing unit 14 sequentially executes the following processing: dark correction for reducing the dark output level of cells corresponding to individual pixels from inputted scan data (data for R, G and B inputted from the film scanner 12), density conversion for logarithmically converting the data resulting from the dark correction into data indicating density, shading correction for correcting the data resulting from the density conversion depending on the unevenness in the quantity of the light thrown on the color negative photographic lightsensitive material 26, and defective pixel correction for newly generating data for cells (defective cells) outputting no signals corresponding to the quantity of the incident light among the data resulting from the shading correction by interpolation on the basis of the data for the surrounding pixels. An output terminal of the line scanner correction section 36 is connected to an input terminal of an I/O controller 38. The data resulting from the above-mentioned processings executed in the line scanner correction section 36 are inputted into the I/O controller 38 as scan data.

The input terminal of the I/O controller 38 is connected to a data-outputting terminal of an image processor 40. From the image processor 40, image data resulting from image processing (described in detail later) are inputted. The input terminal of the I/O controller 38 is connected also to a personal computer 42. The personal computer 42 has an expansion slot (not shown). To the expansion slot, a driver (not shown) for reading/writing of data from/to an information recording medium such as a memory card and a CD-R, or a communication controlling device for communicating with other information processing apparatus. If file image data are inputted through the expansion slot from the outside, the file image data inputted are inputted to the I/O controller 38.

Output terminals of the I/O controller 38 are connected to a data-inputting terminal of the image processor 40, an automatic set-up engine 44, and the personal computer 42, and further to a printer 16 through an I/F circuit 54. The I/O controller 38 selectively outputs the inputted image data to each of the devices connected to its output terminals mentioned above.

In this embodiment, reading is carried out in the film scanner 12 twice at different resolutions for each film image recorded on the color negative photographic lightsensitive material 26. In the first reading at a relatively low resolution (hereinafter referred to as "pre-scan"), reading of the entire surface of the color negative photographic lightsensitive material 26 is conducted under reading conditions (the amount of the light radiated on the color negative photographic lightsensitive material 26 for each wavelength of the light for R, G and B, and the charge accumulation time of the CCD sensor 30) determined so as to prevent occurrence of saturation of accumulated charge in the CCD sensor 30 even in the case where the density of a film image is extremely low (i.e., the case of an under-exposed negative image). The data obtained through the pre-scan (i.e., pre-scan data) are inputted from the I/O controller 38 to the automatic set-up engine 44.

The automatic set-up engine 44 includes a CPU 46, a RAM 48 (for example, a DRAM), a ROM 50 (for example, a ROM in which the content stored thereon can be rewritten) and an I/O port 52, which are connected together via buses. The automatic set-up engine 44 determines a frame position of a film image based on the pre-scan data inputted from the I/O controller 38 and extracts the data (pre-scan image data) corresponding to the film image-recorded region on the color negative photographic lightsensitive material 26. The size of the film image is determined and simultaneously characteristic quantities of an image such as the density are computed on the basis of the pre-scan image data. Thus reading conditions for re-reading of the pre-scanned color negative photographic lightsensitive material 26 at a relatively high resolution (henceforth referred to as "fine scan") conducted by the film scanner 12 are determined. Subsequently, the positions of frames and the reading conditions are outputted to the film scanner 12.

The automatic set-up engine 44 conducts computation of the characteristic quantities of an image including extraction of a main portion in a film image (for example, a region corresponding to the face of a person (a facial region)), automatically determines processing conditions for various kinds of image processing for the image data (fine-scan image data) obtained through the fine scan using the film scanner 12 (set-up computation), and outputs the determined processing conditions to the image processor 40.

To the personal computer 42, a display, a keyboard and a mouse are connected (all not shown). The personal computer 42 captures pre-scan image data from the automatic set-up engine 44 and simultaneously captures image processing conditions determined by the automatic set-up engine 44. The personal computer 42 generates simulation image data by subjecting the pre-scan image data to image processing equivalent to the image processing conducted in the image processor 40 for fine-scan image data on the basis of the processing conditions captured.

The generated simulation image data are converted into signals for displaying an image on a display and a simulation image is displayed on a display based on the signals. An operator checks the displayed image with respect to its image quality and so on. If information, as a result of the check, directing to correct the processing conditions is inputted through the keyboard, the information is outputted to the automatic set-up engine 44. Through this process, processing such as re-computation of processing conditions for image processing or the like is conducted in the automatic set-up engine 44.

On the other hand, the image data (fine-scan image data) inputted into the I/O controller 38 through the fine scan of a film image conducted by the film scanner 12 are inputted from the I/O controller 38 to the image processor 40. The image processor 40 has image processing circuits for performing various kinds of image processing such as density/color conversion processing including gradation conversion and color conversion, image density conversion processing, hyper tone processing by which the gradation of super low frequency bright components of an image are compressed, hyper sharpness processing by which the sharpness of an image is emphasized while image graininess is controlled, and the like. The image processor 40 conducts various image processing for the inputted image data in accordance with the processing conditions determined and informed by the automatic set-up engine 44 for each image.

Examples of image processing that the image processor 40 can conduct including, besides those mentioned above, sharpness correction or soft focus processing for the entire image or a part of the image (for example, a region corresponding to the face of a person), image processing for intentionally changing image tone (e.g., image processing for finishing an output image in monotone, image processing for finishing an output image in portrait-like tone, and image processing for finishing an output image in a sepia tone,) image processing for modifying an image (e.g., image processing for finishing a person in the original image to become slimmer in a main image, and image processing for correcting red-eye,) various kinds of LF aberration correction processing, applied for images taken by the use of an LF (lens-fitted film), for correcting the deterioration of the image quality of output images caused by the characteristics of a lens of an LF, such as distortion aberration of an LF lens, geometric distortion of an image caused by magnification chromatic aberration, color shift, decrease in the brightness of the edge of an image caused by peripheral darkening of an LF lens, and decrease in the sharpness of images caused by the characteristics of an LF lens.

When the image data resulting from image processing performed in the image processor 40 are used for recording of an image on a printing paper, the image data resulting from image processing performed in the image processor 40 are outputted as image data for recording from the I/O controller 38 to the printer 16 through the I/F circuit 54. When the image data resulting from image processing are outputted as an image file to the outside, the image data are outputted from the I/O controller 38 to the personal computer 42. Thus the personal computer 42 outputs the image data, as data for outputting to the outside, inputted from the I/O controller 38 to the outside (e.g., the previously-mentioned driver and communication controlling device) as an image file through an expansion slot.

The printer 16 has an image memory 58, a laser beam source 60 for R, G and B, and a laser driver 62 for controlling the operation of the laser beam source 60. The image data for recording inputted from the image processing unit 14 are temporarily stored in the image memory 58 and then read out to be used for the modulation of the laser beams for R, G and B emitted from the laser beam source 60. The laser beams emitted from the laser beam source 60 are scanned on a printing paper 68 through a polygon mirror 64 and an fθ lens 66. Thereby an image is recorded on the printing paper 68 by exposure. The printing paper 68 having thereon an image recorded by exposure is conveyed to a processor section 18 to be subjected to various processing of color development, bleach-fixing, washing and drying. Through such a process, the image recorded on the printing paper 68 by exposure is visualized.

A high image density of a photographic lightsensitive material is undesirable because it reduces the quantity of light during scanner reading, resulting in an insufficient S/N ratio of an image, or requires an expensive and large light source capable of emitting a large quantity of light.

Therefore, even a color negative photographic lightsensitive material for photographing has become to be required that it can form an image in a density as low as possible, more specifically, that a light-sensitive material is designed so as to have a minimum density (density of unexposed portion) as low as possible.

The "colored coupler" used in the present invention is also generally called "colored masking coupler" and indicates a coupler that is initially colored and loses the initial color or changes to another color after its reaction with a developing agent in an oxidized form occurring during a development process.

When a colored coupler is used, an imagewise image having a color complementary to the original color can be obtained. In the conventional color negative photographic lightsensitive materials, colored couplers are essential materials used for color correction, for example, correction of color muddiness caused by side absorption by main couplers.

As described in EP No. 1016911 (JP-A-11-174637) and so on, it has found that, for lightsensitive materials designed on the precondition of executing image processing after digital scanning using a scanner or the like, the above-mentioned color correction rather causes noises in digital operations than is not necessary.

The silver halide color negative photographic lightsensitive material according to the present invention is required that the total coating amount of the colored couplers is less than 0.05 mMol/$m^2$. If the total coating amount is that value or more, the minimum negative density after development becomes too high. The total coating amount of the colored couplers is preferably less than 0.02 mMol/$m^2$, more preferably less than 0.01 mMol/$m^2$. It is desirable that no colored couplers are used in the silver halide color negative photographic lightsensitive material according to the present invention.

Spectral sensitization is a very common technique in the science of silver halide photographic lightsensitive materials. So, it is not particularly described here.

Usually in the case of silver halide color photo-graphic lightsensitive materials for photographing, a red-sensitive layer and a green-sensitive layer must be spectrally sensitized. Spectral sensitization of a blue-sensitive layer is not necessary, but this layer is often spectrally sensitized.

A "spectrally sensitized region" referred to in the present invention indicates a wavelength region in which the silver halide emulsion is sensitized with a spectrally sensitizing dye and is defined as a region having, as a result of spectral sensitization, a sensitivity as strong as 25% or more of the sensitivity at the maximum sensitivity wavelength resulting from the spectral sensitivity.

If a wavelength region sensitized by a spectrally sensitizing dye and an intrinsic sensitivity region of the silver halide at least partly overlap, the "spectrally sensitized region" in the present invention does not include a wavelength region where an emulsion has, even without any spectrally sensitizing dye, a sensitivity as strong as 25% or more of the sensitivity at the maximum sensitivity wavelength resulting from the spectral sensitization.

The spectrally sensitized region can be determined by measuring a spectral sensitivities that change depending upon the presence or absence of a spectrally sensitizing dye using a method well-known among those skilled in the art.

Usually, the spectrally sensitized region is often from 530 nm to 700 nm for red-sensitive layers, and from 460 nm to 600 nm for green-sensitive layers. In the case of blue-sensitive layers, although more accurate and careful experiments are required because a wavelength region sensitized by a spectrally sensitizing dye overlaps an intrinsic sensitivity region of a silver halide having sensitivity without any spectrally sensitizing dye, the layers have a spectrally sensitized region of from 400 nm to 500 nm or has no "spectrally sensitized region" defined in the present invention even though the layers are spectrally sensitized.

The "compound capable of absorbing a light within a spectrally sensitized region" indicates a compound showing absorption in the "spectrally sensitized region" defined above and reduces the sensitivity of the spectrally sensitized silver halide emulsion by the absorption of light. The "sensitivity of a silver halide emulsion" is a sensitivity at the maximum sensitivity wavelength resulting from the spectral sensitization.

For example, even if a yellow compound showing absorption at 460 nm is contained in the present lightsensitive material, if the sensitivity of an emulsion having a maximum sensitivity wavelength resulting from spectral sensitization at 460 nm is not reduced by the presence of the yellow compound from some reasons, for example, that the compound is fixed in a layer formed below the blue-sensitive layers, the compound does not correspond to the "compound capable of absorbing a light within a spectrally sensitized region" defined in the present invention. Further, the spectrally sensitizing dye itself does not correspond to the "compound capable of absorbing a light within a spectrally sensitized region" defined in the present invention because it does not reduce the sensitivity of an emulsion.

The "compound capable of absorbing a light within a spectrally sensitized region" has to reduce the sensitivity of the spectrally sensitized silver halide emulsion by at least 0.05 LogE. To obtain a light-sensitive material showing a better sharpness, it is desirable to reduce the sensitivity of the spectrally sensitized silver halide emulsion by at least 0.10 LogE. The sensitivity is determined by a method described in Example 1 and is defined using a logarithm of a reciprocal (E) of an exposure giving Dmin plus a density of 0.2.

Such compounds are conventionally known in the art as so-called anti-irradiation compounds. Recently, for example, JP-A-6-19075 has disclosed an improvement of sharpness using a combination with an emulsion of tabular grains with a high aspect ratio.

However, nobody has known that those compounds have a specific effect on the deterioration in sharpness in light-sensitive materials substantially free from colored couplers according to the present invention.

The compound capable of absorbing a light within a spectrally sensitized region according to the present invention preferably changes to substantially colorless after a development process. In order for the compound to change to substantially colorless, it is preferable that the compound flows out of the lightsensitive material during a development process or changes, during a development process, to a compound absorbing substantially no light within the spectrally sensitized region of the spectrally sensitized silver halide emulsion.

In the present invention, "a compound following out of a lightsensitive material during a development process" means that the compound is removed from the lightsensitive material during a development process including color development, bleaching, fixing and is washing to 10% by weight or less of its original quantity. The compound is preferably reduced to 3% by weight or less, more preferably to 1% by weight or less.

As the compound capable of absorbing a light within a spectrally sensitized region which flows out of a lightsensitive material during a development process, water-soluble dyes can suitably be employed.

As dyes preferable as the water-soluble dyes, compounds represented by the following general formula (A) are cited.

$$D_1-(X_1)y_1 \quad \text{(A)}$$

In the formula, $D_1$ represents a group derived from a compound having a chromophore; $X_1$ represents a dissociatable proton bonded directly or via a divalent linking group to $D_1$, or a group having a dissociatable proton and being bonded directly or via a divalent linking group to $D_1$; and $Y_1$ represents an integer of from 1 to 7.

The compound having a chromophore can be selected from many known dye compounds. As such compounds, oxonol dyes, merocyanine dyes, cyanine dyes, arylidene dyes, azomethine dyes, triphenylmethane dyes, an azo dyes, an anthraquinone dyes, an indoaniline dyes and so on can be cited.

Specific examples of the above-mentioned compound are shown below, but the compound is not limited to these examples.

(AI-1)
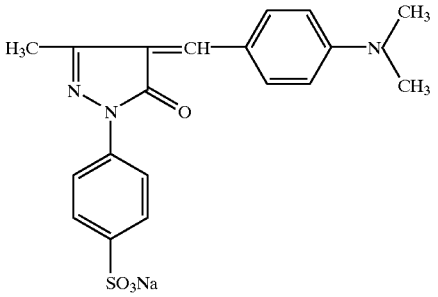
(AI-2)
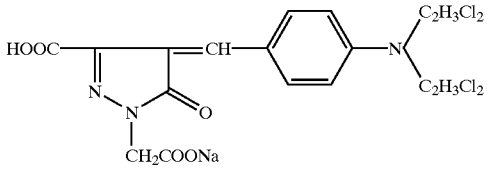
(AI-3)
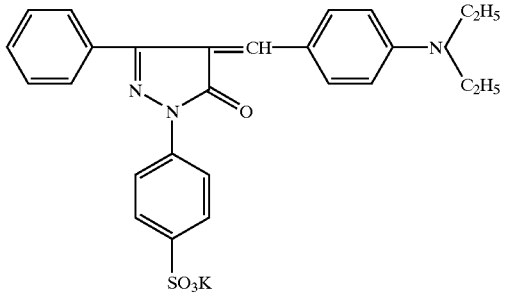
(AI-4)
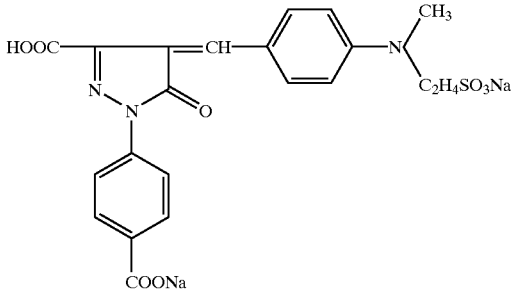
(AI-5)
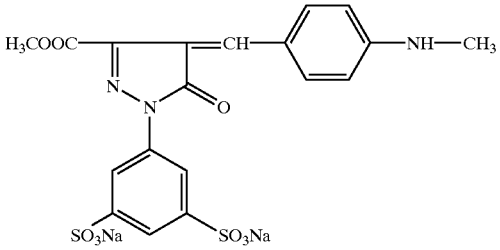
(AI-6)
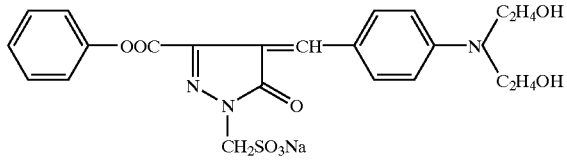
(AI-7)
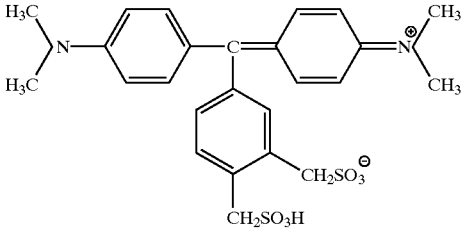
(AI-8)
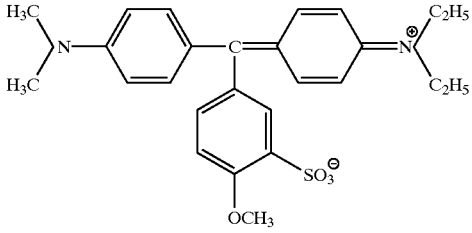
(AI-9)
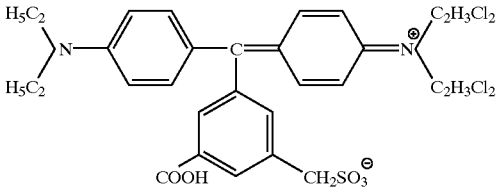
(AI-10)
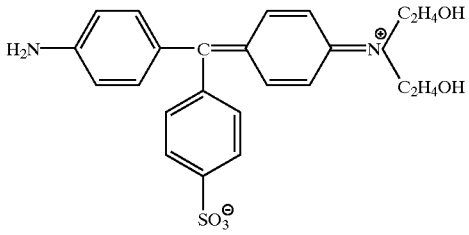
(AI-11)
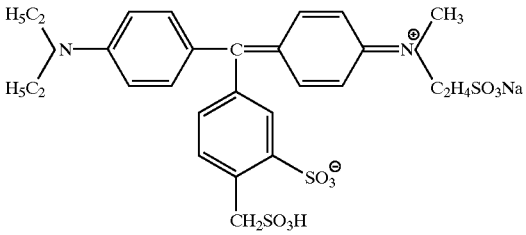
(AI-12)
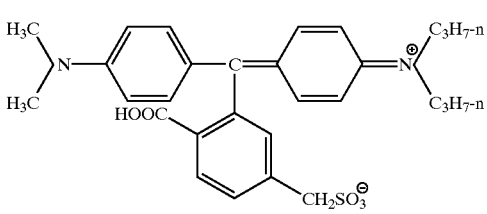

-continued
(AI-13)
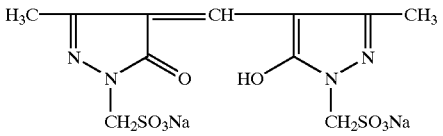
(AI-14)
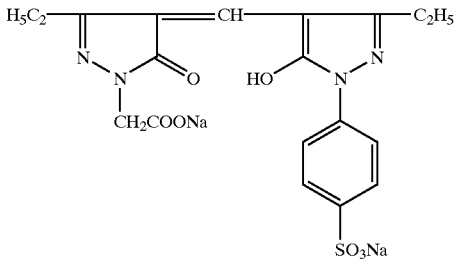
(AI-15)
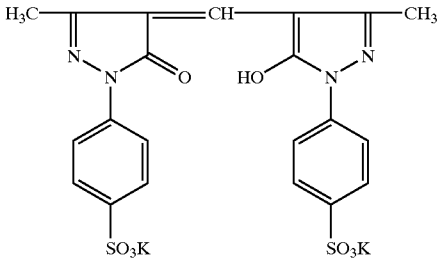
(AI-16)
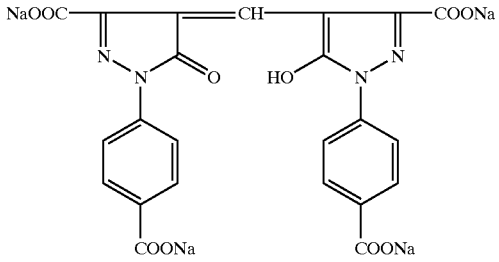
(AI-17)
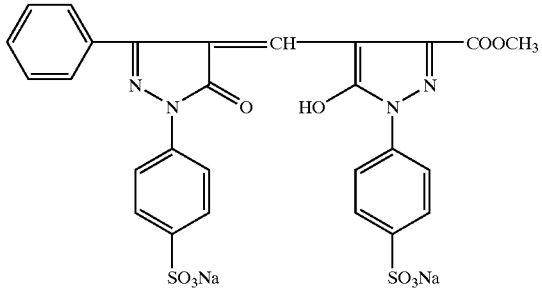
(AI-18)
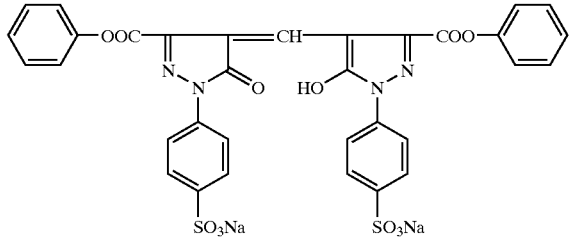
(AI-19)
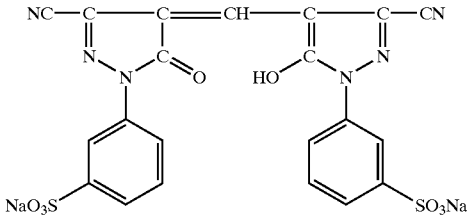
(AI-20)
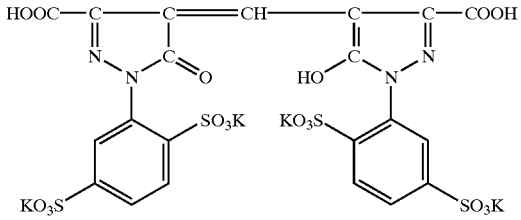
(AI-21)
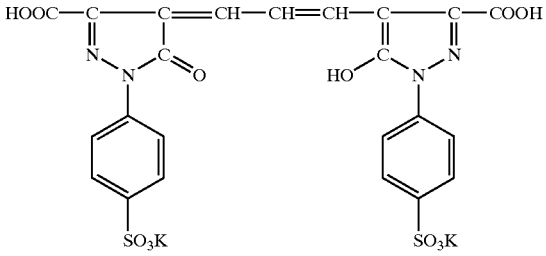
(AI-22)
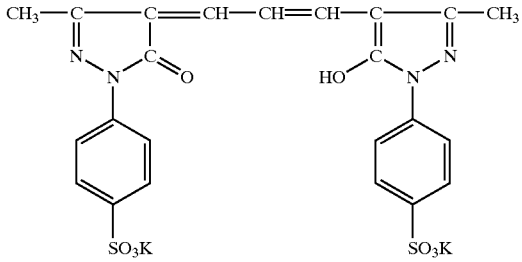

-continued
(AI-23)
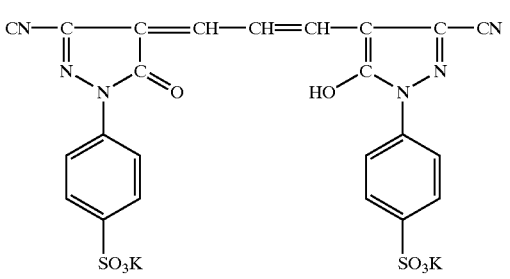
(AI-24)
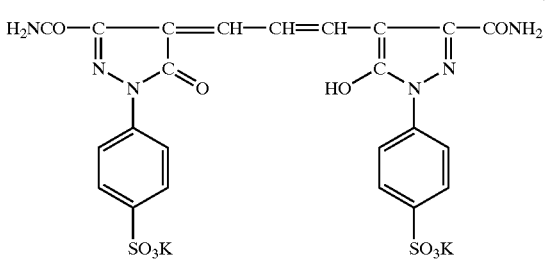
(AI-25)
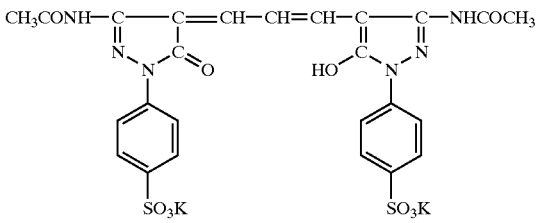
(AI-26)
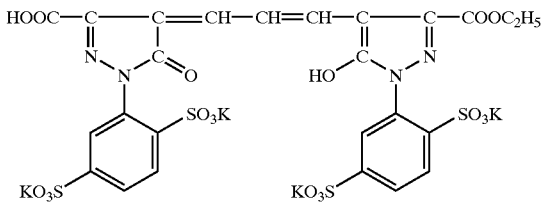
(AI-27)
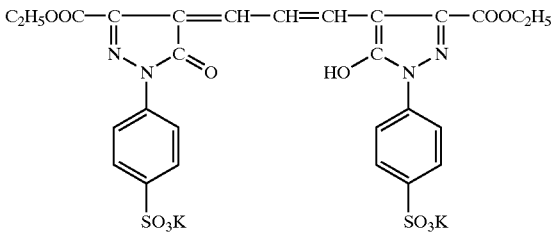
(AI-28)
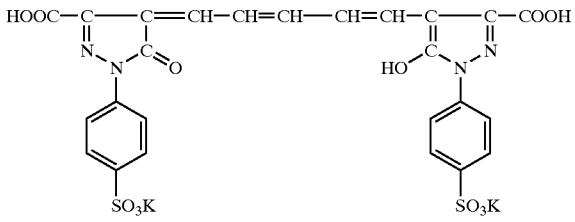
(AI-29)
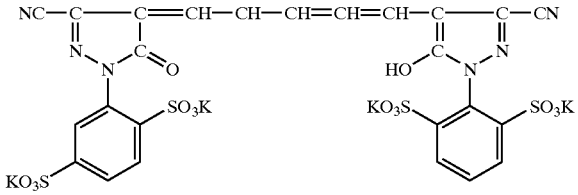
(AI-30)
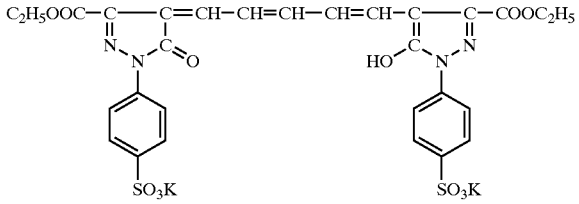
(AI-31)
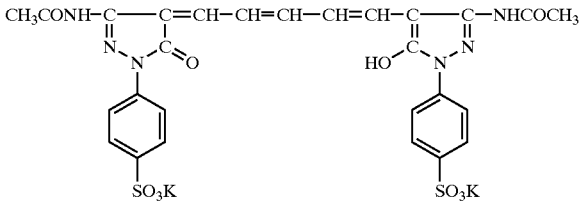
(AI-32)
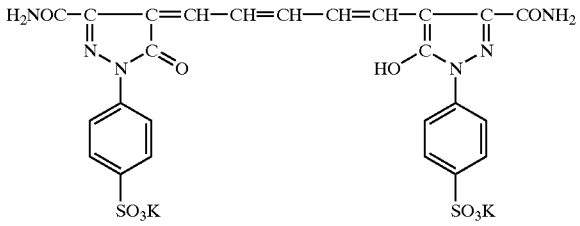
(AI-33)
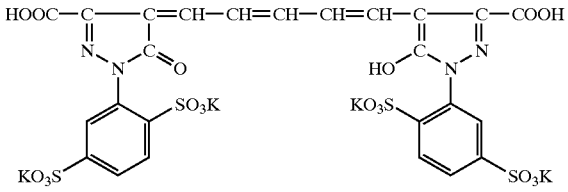
(AI-34)
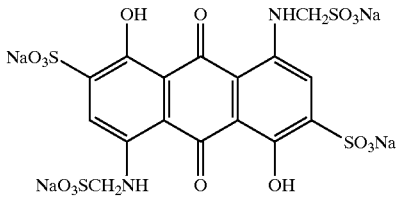

-continued
(AI-35)
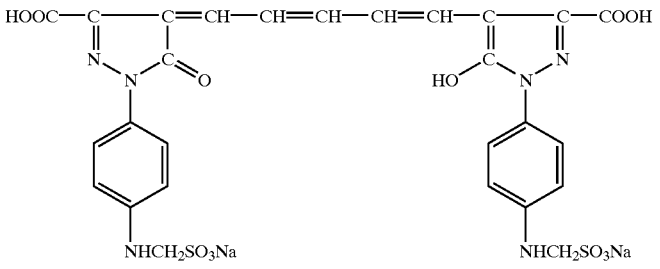
(AI-36)
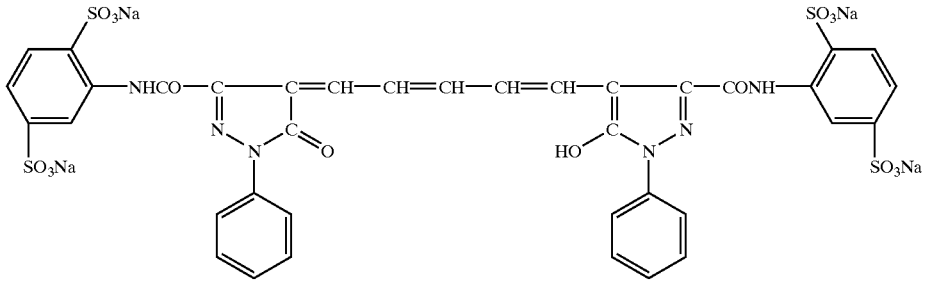
(AI-37)
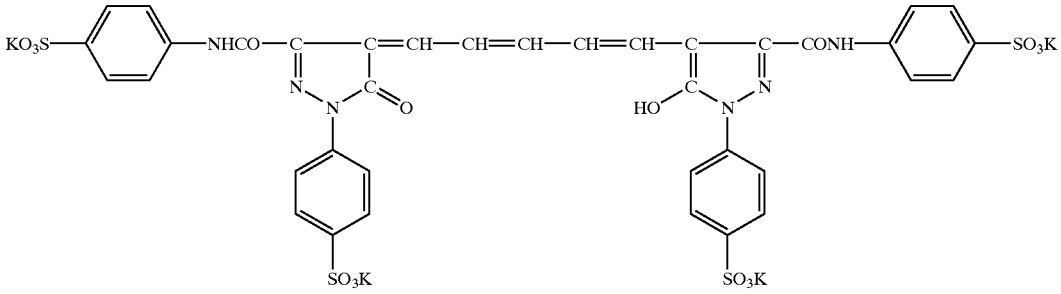
(AI-38)
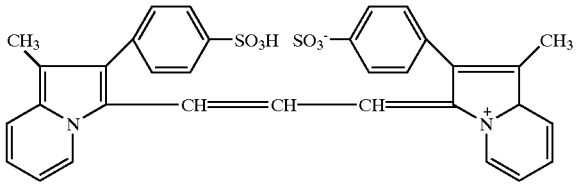
(AI-39)
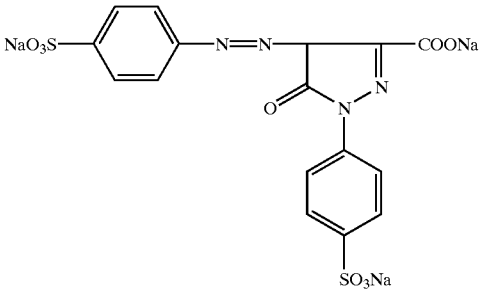
(AI-40)
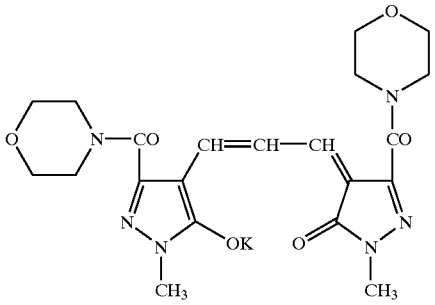
(AI-41)
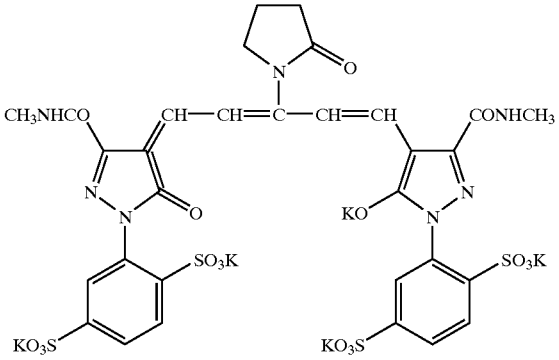

Many of the above-described water-soluble dyes have diffusibility such that they can move between layers during or after application of a lightsensitive material. Therefore, they are expected to distribute almost uniformly in an emulsion layer. On the other hand, for example, U.S. Pat. Nos. 4,312,941 and 4,855,220 and JP-A-62-166330, the entire contents of which are herein incorporated by reference, disclose an effect obtained by fixing a dye in a specific layer. It is also preferable that such an effect is utilized in the present invention. Specific examples of such a non-diffusible dye, its preparation method, the method for its introduction into a photographic material are disclosed also in U.S. Pat. Nos. 4,756,600 and 4,956,269 and Research Disclosure Item 308119 (December 1989), the entire contents of which are herein incorporated by reference, and so on besides the above-cited patent publications.

These dyes may be ballasted so that they are rendered non-diffusible or may be rendered non-diffusible by use of an organic mordanting material such as a charged or uncharged polymer matrix, or may be rendered non-diffusible through their adsorption on fine inorganic or organic solids dispersed in a membrane. Further, these dyes may be introduced into polymer latexes or may be covalently bonded to polymer materials. Furthermore, solid disperse dyes disclosed in JP-A's 5-197078 and 8-50345, the entire contents of which are incorporated herein by reference, and so on may be employed.

Such a non-diffusible dye is added to an emulsion layer spectrally sensitized within a region that is the same as that of the non-diffusible dye or a layer provided farther from a support than the above-mentioned emulsion layer. It is preferable that the non-diffusible dye is added to a layer provided farther from the support than a lightsensitive layer.

If such a non-diffusible dye is employed as the compound capable of absorbing a light within a spectrally sensitized region defined in the present invention, that the non-diffusible dye becomes substantially colorless through undergoing some change during a development process or flowing out of a lightsensitive material during a development process as previously described is one of preferred embodiments of the present invention.

Further, another preferred embodiment of the present invention is that the non-diffusible dye changes during a development process into a compound absorbing substantially no light within the spectrally sensitized region of the spectrally sensitized silver halide emulsion as further described below.

"A compound changes during a development process into another compound absorbing substantially no light within the spectrally sensitized region of the spectrally sensitized silver halide emulsion" means that a compound, which is capable of absorbing light in the wavelength spectrally sensitized region of the spectrally sensitized silver halide emulsion, changes, during a development process, including color development, bleaching, fixing and washing, into another compound whose absorption at the maximum sensitivity wavelength of the silver halide emulsion resulting from the spectral sensitization of the silver halide emulsion is reduced to 10% or less (preferably 3% or less, and more preferably 1% or less) of the original absorption of the compound at the same wavelength as the maximum sensitivity wavelength.

As the "compound that changes during a development process into another compound absorbing substantially no light within the spectrally sensitized region of the spectrally sensitized silver halide emulsion", compounds represented by the following general formula (I) are recited.

$$D-(X)y \quad \text{(I)}$$

In the formula, D represents a group derived from a compound having a chromophore; X represents a dissociatable proton bonded directly or via a divalent linking group to D or a group having a dissociatable proton and being bonded directly or via a divalent linking group to D; and y represents an integer of from 1 to 7.

The following is a detailed description concerning general formula (I). The compound having a chromophore can be selected from many known dye compounds. As such compounds, oxonol dyes, merocyanine dyes, cyanine dyes, arylidene dyes, azomethine dyes, triphenylmethane dyes, an azo dyes, an anthraquinone dyes, an indoaniline dyes and so on can be cited.

The dissociatable proton or the group having a dissociatable proton represented by X has such characteristics that it is not dissociated in the state where the compound represented by general formula (I) is contained in a silver halide photographic lightsensitive material and renders the compound represented by general formula (I) substantially water-insoluble, and is dissociated to render the compound represented by general formula (I) substantially water-soluble during a step where the lightsensitive material is developed. Examples of such groups include a carboxylic acid group, a sulfonamide group, an arylsulfamoyl group, a sulfonylcarbamoyl group, a carbonylsulfamoyl group, and an enol group of an oxonol dye.

Preferable compounds represented by general formula (I) include those represented by the following general formulas (II), (III), (IV) or (V).

$$A_1=L_1-(L_2=L_3)_m-Q \quad \text{(II)}$$

$$A_1=L_1-(L_2=L_3)_n-A_2 \quad \text{(III)}$$

$$A_1=(L_1-L_2)_p-B_1 \quad \text{(IV)}$$

$$(NC)_2C=C(Q)CN \quad \text{(V)}$$

In the formulas, $A_1$ and $A_2$ each represent an acidic nucleus; $B_1$ represents a basic nucleus; Q represents an aryl group or a heterocyclic group; $L_1$, $L_2$ and $L_3$ each represent a methine group; m represents 0, 1 or 2; and n and p each represent 0, 1, 2 or 3; provided that the compounds represented by general formulas (II) through (V) each contains, in one molecule, at least one group selected from the group consisting of a carboxylic acid group, a sulfonamide group, an arylsulfamoyl group, a sulfonylcarbamoyl group, a carbonylsulfamoyl group and an enol group of an oxonol dye and does not contain any water-soluble group other than the above (e.g., a sulfonic acid group and a phosphoric acid group).

The acidic nucleus represented by $A_1$ or $A_2$ is preferably a cyclic ketomethylene compound or a compound having a methylene group intervening between electron withdrawing groups. Examples of the cyclic ketomethylene compound include 2-pyrazolin-5-one, rhodanine, hydantoin, thiohydantoin, 2,4-oxazolidinedione, isooxazolone, barbituric acid, thiobarbituric acid, indanedione, dioxopyrazolopyridine, hydroxypyridone, pyrazolidinedione and 2,5-dihydrofuran. These compounds may have a substituent.

The compound having a methylene group intervening between electron.withdrawing groups can be represented by $Z_1CH_2Z_2$, wherein $Z_1$ and $Z_2$ each represent CN, $SO_2R_1$, $COR_1$, $COOR_2$, $CONHR_2$ or $SO_2NHR_2$; $R_1$ represents an alkyl group, an aryl group or a heterocyclic group; $R_2$ represents a hydrogen atom or a group represented by $R_1$; and each of $R_1$ and $R_2$ may have a substituent.

Examples of the basic nucleus represented by $B_1$ include pyridine, quinoline, indolenine, oxazole, imidazole, thiazole, benzoxazole, benzoimidazole, benzothiazole, oxazoline, naphthoxazole and pyrrole, and each of them may have a substituent.

Examples of the aryl group represented by Q include a phenyl group and a naphthyl group. Each of them may have a substituent. Examples of the heterocyclic group represented by Q include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin and coumarone, from each of which a hydrogen atom is removed. Each of them may have a substituent.

The methine groups represented by $L_1$, $L_2$ and $L_3$ each may have a substituent, and the substituents may be bonded one another to form a 5- or 6-membered ring.

The substituents that each of the above-described group may have are not particularly limited unless they renders the compounds represented by general formulae (I) through (V) substantially dissolve in water of pH 5 to 7. Examples thereof include a carboxylic acid group, a sulfonamide group having from 1 to 10 carbon atoms (e.g., methanesulfonamide, benzenesulfonamide, butanesulfonamide, and n-octanesulfonamide), a sulfamoyl group having from 0 to 10 carbon atoms (e.g., unsubstituted sulfamoyl, methylsulfamoyl, phenylsulfamoyl, and butylsulfamoyl), a sulfonylcarbamoyl group having from 2 to 10 carbon atoms (e.g., methanesulfonylcarbamoyl, propanesulfonylcarbamoyl, and benzenesulfonylcarbamoyl), an acylsulfamoyl group having from 1 to 10 carbon atoms (e.g., acetylsulfamoyl, propionylsulfamoyl, pivaloylsulfamoyl, and benzoylsulfamoyl), an alkyl group having from 1 to 8 carbon atoms (e.g., methyl, ethyl, isopropyl, butyl, hexyl, 2-hydroxyethyl, 4-carboxybutyl, 2-methoxyethyl, benzyl, phenethyl, 4-carboxybenzyl, and 2-diethylaminoethyl), an alkoxy group having from 1 to 8 carbon atoms (e.g., methoxy, ethoxy, and butoxy), a halogen atom (e.g., F, Cl, and Br), an amino group having from 0 to 10 carbon atoms (e.g., unsubstituted amino, dimethylamino, diethylamino, and carboxyethylamino), an ester group having from 2 to 10 carbon atoms (e.g., methoxycarbonyl), an amide group having from 1 to 10 carbon atoms (e.g., acetylamino, and benzamide), a carbamoyl group having from 1 to 10 carbon atoms (e.g., unsubstituted carbamoyl, methylcarbamoyl, and ethylcarbamoyl), an aryl group having from 6 to 10 carbon atoms (e.g., phenyl, naphthyl, 4-carboxyphenyl, 3-carboxyphenyl, 3,5-dicarboxyphenyl, 4-methanesulfonamidephenyl, and 4-butanesulfonamidephenyl), an acyl group having from 1 to 10 carbon atoms (e.g., acetyl, benzoyl, and propanoyl), a sulfonyl group having from 1 to 10 carbon atoms (e.g., methanesulfonyl, and benzenesulfonyl), a ureido group having from 1 to 10 carbon atoms (e.g., is ureido,-and methylureido), a urethane group having from 2 to 10 carbon atoms (e.g., methoxycarbonylamino, and ethoxycarbonylamino), a cyano group, a hydroxyl group, a nitro group, and a heterocyclic group (e.g., a 5-carboxybenzoxazole ring, a pyridine ring, a sulforan ring, and a furan ring). The compound represented by general formula (I) is preferably dispersed in the form of solid fine grains. With respect to the grain size of the fine grains, the grains preferably have an average grain diameter of 2 $\mu$m or less, more preferably 1 $\mu$m or less. The addition amount of the compound is preferably from $5\times10^{-2}$ to $5\times10^{-7}$ mol/m$^2$, especially preferably from $1\times10^{-3}$ to $5\times10^{-5}$ mol/m$^2$. With respect to what layer the compound represented by general formula (I) is added to, the compound is preferably added to a layer arranged farther than a lightsensitive layer from the support.

The following are specific examples of the compounds represented by general formulae (I) through (V), but the present invention is not limited to them.

(I-1)

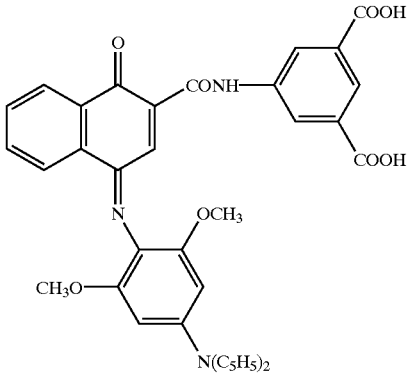

(I-2)

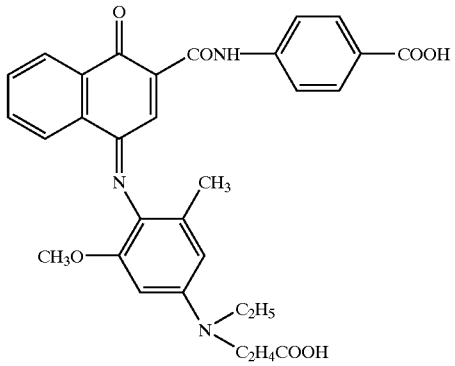

(I-3)

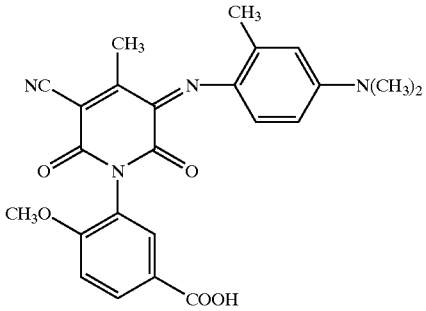

(I-4)

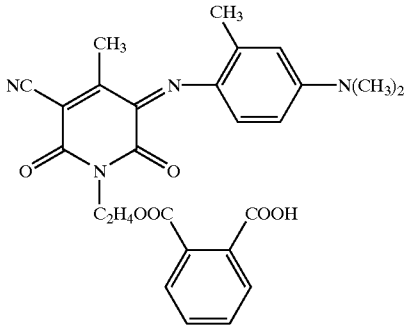

-continued
(II-1)
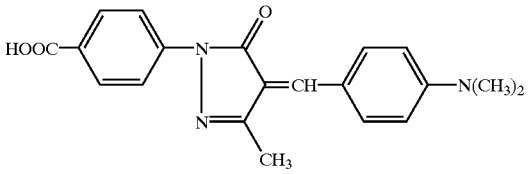
(II-2)
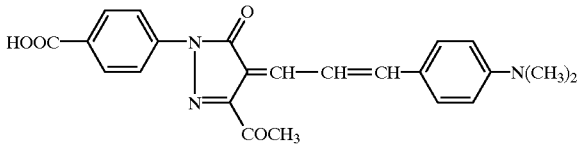
(II-3)
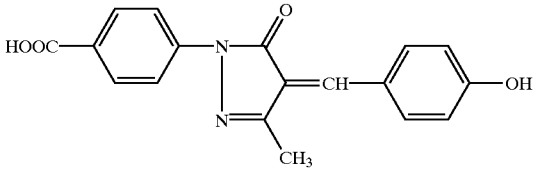
(II-4)
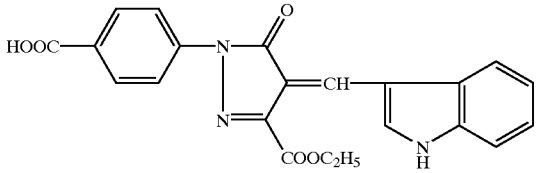
(II-5)
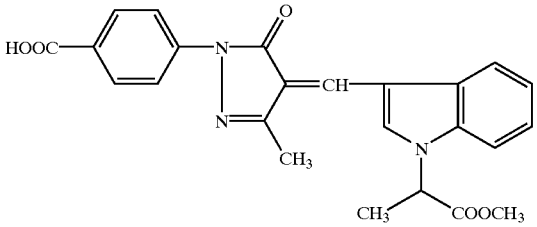
(II-6)
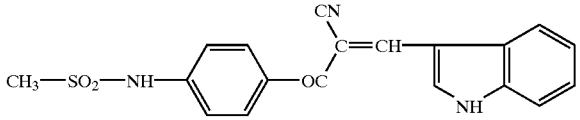
(II-7)
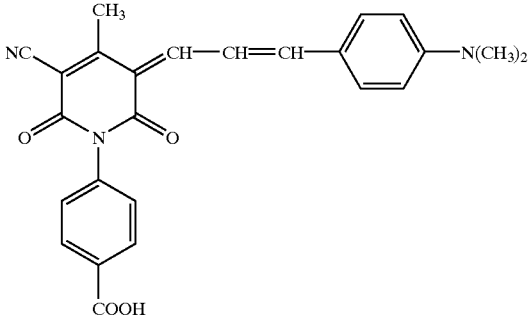
(II-8)
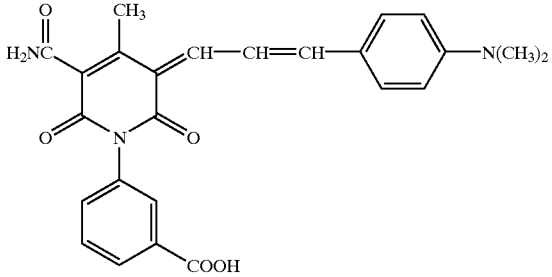
(II-9)
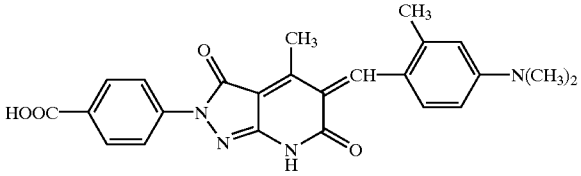
(II-10)
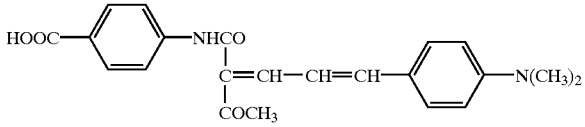
(II-11)
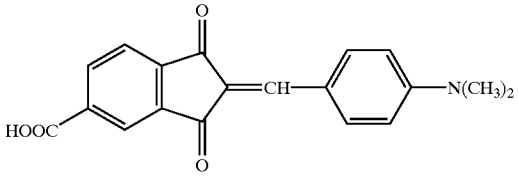
(II-12)
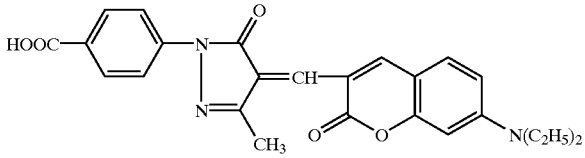
(II-13)
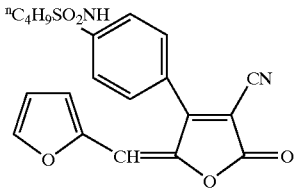
(II-14)
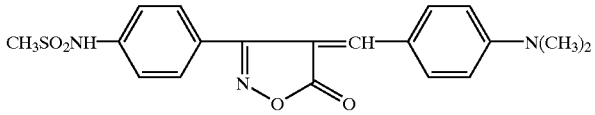

-continued
(II-15)
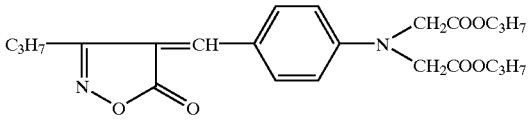
(II-16)
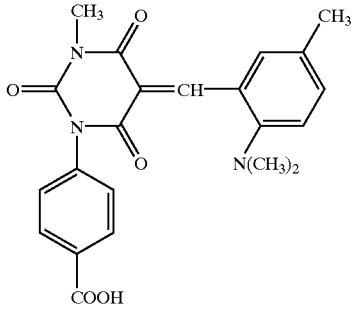
(II-17)
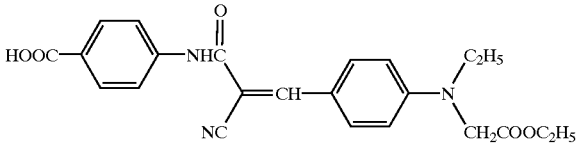
(III-1)
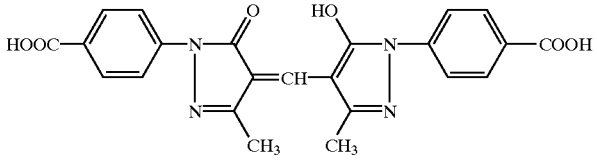
(III-2)
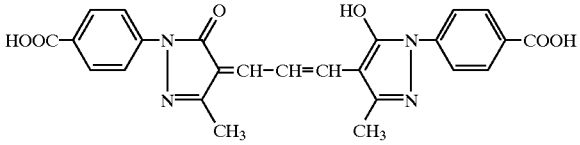
(III-3)
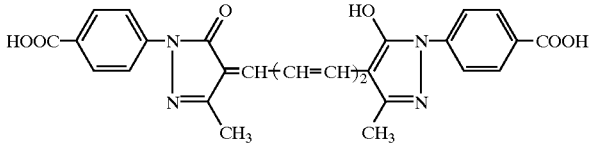
(III-4)
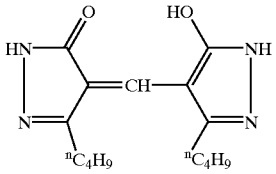
(III-5)
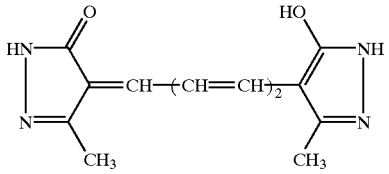
(III-6)
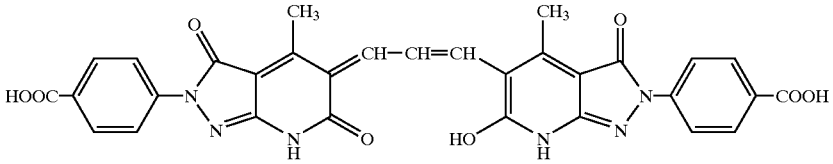
(III-7)
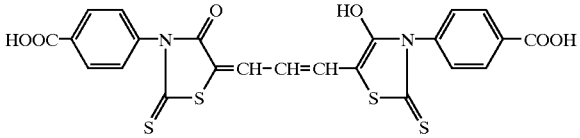
(III-8)
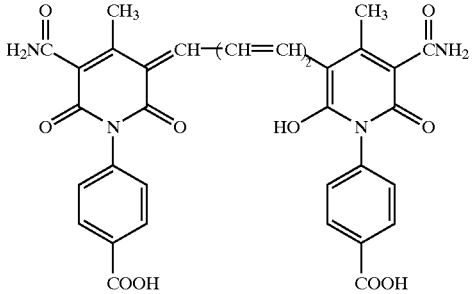
(III-9)
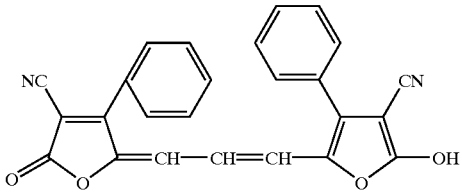

-continued
(III-10)
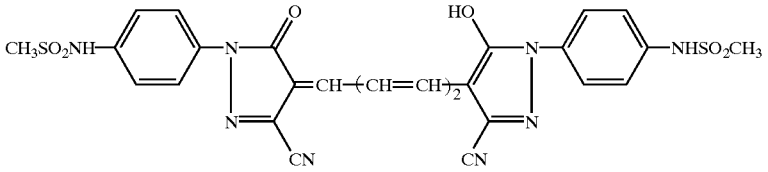
(II-18)
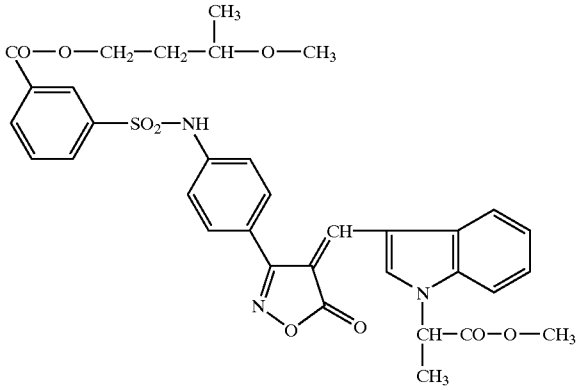
(IV-1)
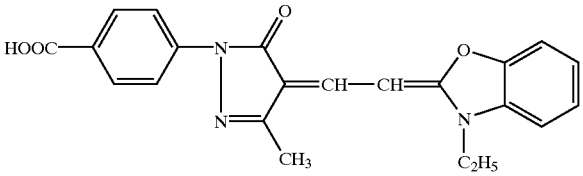
(IV-2)
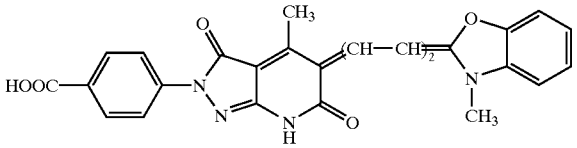
(IV-3)
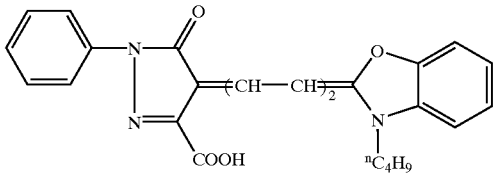
(IV-4)
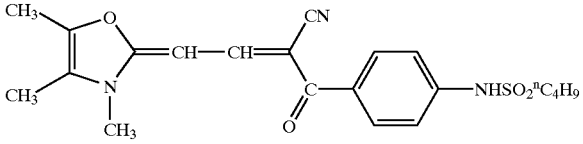
(IV-5)
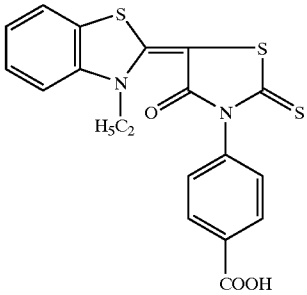
(IV-6)
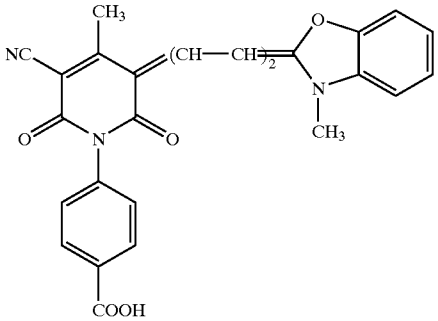
(V-1)
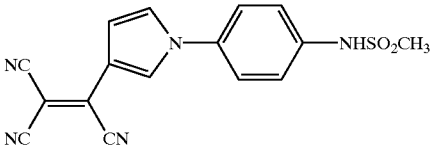

-continued
(V-2)
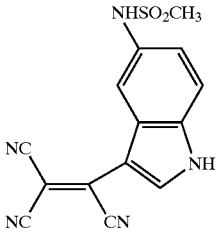
(V-3)
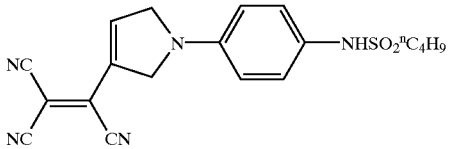
(III-8)
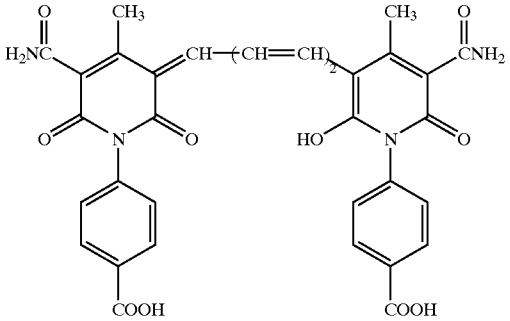
(III-9)
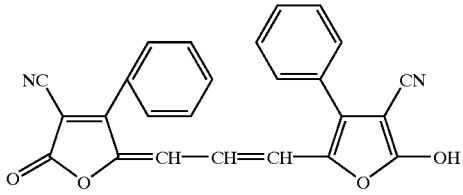
(III-10)
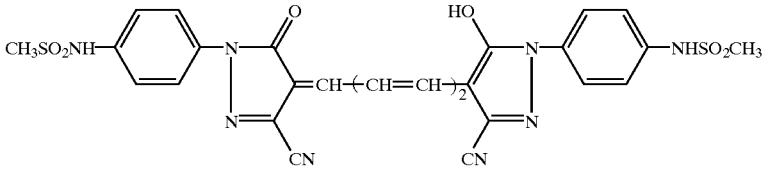
(II-18)
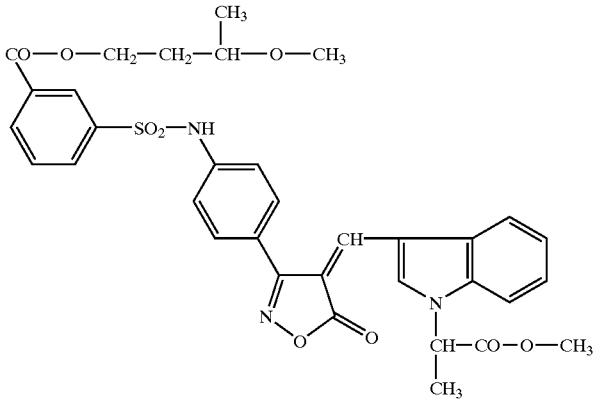
(IV-1)
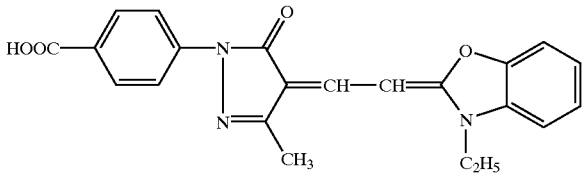
(IV-2)
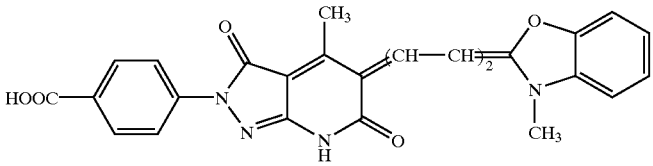
(IV-3)
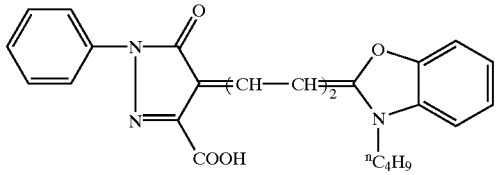

-continued (IV-4)

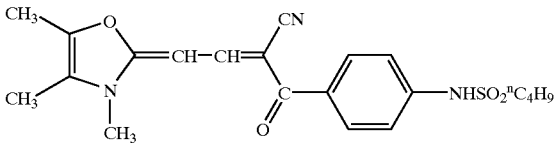

(IV-5)

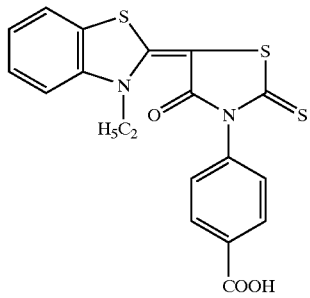

(IV-6)

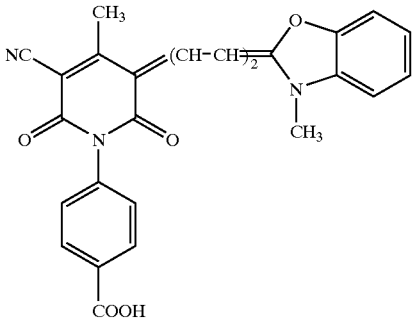

(V-1)

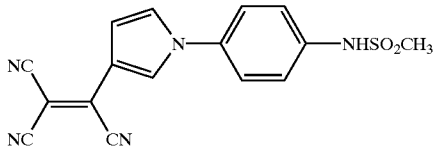

(V-2)

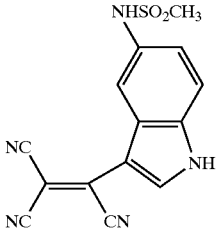

(V-3)

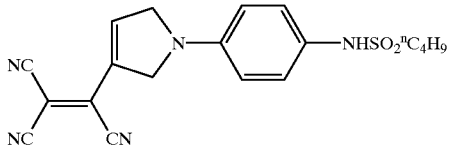

It is very important to manufacture products of the same performance constantly. What is important for achievement of this goal is that external disturbance such as fluctuations in measurement and those in temperature generated during a manufacturing process result only in small fluctuations in performance of products. Practically, the production stability can be evaluated through an observation of performance fluctuations response to external disturbance forcefully applied.

The silver halide color negative photographic lightsensitive material that can be applied to the present invention can use various additives according to its purpose. These additives are described in detail in Research Disclosure Item 17643 (December 1978), Item 18716 (November 1979) and Item 308119 (December 1989), the entire contents of which are incorporated herein by reference. A summary of the locations where they are described will be listed in the following table.

| Types of additives | RD17643 | RD18716 | RD308119 |
|---|---|---|---|
| 1 Chemical -sensitizers | page 23 | page 648 right column | Page 996 |
| 2 Sensitivity increasing agents | | page 648 right column | |

-continued

| Types of additives | RD17643 | RD18716 | RD308119 |
|---|---|---|---|
| 3 Spectral sensitizers, super-sensitizers | pages 23–24 | page 648, right column to page 649, right column | page 996, right column to page 998, right column |
| 4 Brighteners | page 24 | right column | page 998 |
| 5 Antifoggants, and stabilizers | page 24–25 | page 649 right column | page 998, right column to page 1000, right column |
| 6 Light absorbents, filter dyes, ultraviolet absorbents | pages 25–26 | page 649, right column to page 650, left column | page 1003, left column to page 1003, right column |
| 7 Stain preventing agents | page 25, right column | page 650, left to right columns | page 1002, right column |
| 8 Dye image stabilizers | page 25 | | page 1002, right column |
| 9 Film hardeners | page 26 | page 651, left column | page 1004, right column to page 1005, left column |
| 10 Binders | page 26 left column | page 651, right column | page 1003, to page 1004, right column |

-continued

| Types of additives | RD17643 | RD18716 | RD308119 |
|---|---|---|---|
| 11 Plasticizers, lubricants | page 27 | page 650, right column | page 1006, left to right columns |
| 12 Coating aids, surfactants | page 26–27 | page 650, right column | page 1005, left column to page 1006, left column |
| 13 Antistatic agents | page 27 | page 650, right column | page 1006, right column to page 1007, left column |
| 14 Matting agents | | | page 1008, left column to page 1009, left column. |

With respect to the layer arrangement and related techniques, silver halide emulsions, dye forming couplers, DIR couplers and other functional couplers, various additives and development processing which can be used in the silver halide photographic light-sensitive material that can be applied to the present invention, reference can be made to EP 0565096A1 (published on Oct. 13, 1993), the entire contents of which are incorporated herein by reference, and patents cited therein. Individual particulars and the locations where they are described will be listed below.

1. Layer arrangement: page 61 lines 23 to 35, page 61line 41 to page 62 line 14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogged emulsions: page 63 lines 14 to 31,
15. Nonlightsensitive emulsions: page 63 lines 32 to 43,
16. Silver coating amounts: page 63 lines 49 to 50,
17. Photographic additives: The additives are described in RD Item 17643 (December, 1978), RD Item 18716 (November, 1979) and RD 307105 (November, 1989). Individual particulars and the locations where they are described will be listed below.

| Types of Additives | RD17643 | RD18716 | RD307105 |
|---|---|---|---|
| (1) Chemical sensitizers | page 23 | page 648 right column | page 866 |
| (2) Sensitivity increasing agents | | page 648 right column | |

-continued

| Types of Additives | RD17643 | RD18716 | RD307105 |
|---|---|---|---|
| (3) Spectral sensitizers, super sensitizers | pages 23–24 | page 648, right column to page 649, right column | page 866–868 |
| (4) Brighteners | page 24 | page 647, right column | page 868 |
| (5) Antifoggants, stabilizers | page 24–25 | page 649, right column | pages 868–870 |
| (6) Light absorbents, filter dyes, ultraviolet absorbents | pages 25–26 | page 649, right column to page 650, to page 650, | page 873 |
| (7) Stain-inhibiting agent | page 25, right column | page 650, left to right column | page 872 column |
| (8) Color image stabilizing agent | page 25, | page 650, left column | page 872 |
| (9) Film hardener | page 26 | page 651, left column | page 874–875 |
| (10) Binders | page 26 | page 651, left column | page 873–874 |
| (11) Plasticizers, lubricants | page 27 | page 650, right column | page 876 |
| (12) Coating aids, surfactants | pages 26–27 | page 650, right column | pages 875–876 |
| (13) Antistatic agents | page 27 | page 650, right column | pages 876–877 |
| (14) Matting agents | | | pages 878–879. |

18. Formaldehyde scavengers: page 64 lines 54 to 57,
19. Mercapto antifoggants: page 65 lines 1 to 2,
20. Fogging agent, etc.-releasing agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye-forming couplers: page 65 lines 29 to 31,
26. Colored couplers: page 65 lines 32 to 38,
27. Functional coupler summary: page 65 lines 39 to 44,
28. Bleaching accelerator-releasing couplers: page 65 lines 45 to 48,
29. Development accelerator release couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swelling speed: page 66 line 40 to page 67 line 1,
35. Back layers: page 67 lines 3 to 8,
36. Development processing summary: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution open ratio: page 67 line 57 to page 68 line 12,
41. Development time: page 68 lines 13 to 15,
42. Bleach-fix, bleaching and fixing: page 68 line 16 to page 69 line 31, 43. Automatic processor: page 69 lines 32 to 40,
44. Washing, rinse and stabilization: page 69 line 41 to page 70 line 18,
45. Processing solution replenishment and recycling: page 70 lines 19 to 23,
46. Developing agent build-in sensitive material: page 70 lines 24 to 33,
47. Development processing temperature: page 70 lines 34 to 38, and
48. Application to lens-fitted film: page 70 lines 39 to 41

Examples

The present invention will be described in more detail below with reference to the following examples, but the invention is not limited to the examples.

Example 1

A color lightsensitive material was prepared in the following procedure.

Comparative sample 001 as a multilayered color lightsensitive material was prepared by coating of an undercoated cellulose triacetate film support with multiple layers having the following compositions.

(Compositions of lightsensitive layers)

The main materials used in the individual layers are classified as follows.

ExC: Cyan coupler; ExS: Spectrally sensitizing dye;

UV: Ultraviolet absorbent; ExM: Magenta coupler;

HBS: High-boiling organic solvent;

ExY: Yellow coupler; H: Gelatin hardener (In the following description, specific compounds are indicated by symbols followed by numerals. Chemical formulas of these compounds will be presented later.)

The number corresponding to each component indicates the coating amount in g/m$^2$. The coating amount of a silver halide is indicated in terms of the amount of silver. The coating amount of a spectrally sensitizing dye is indicated in mol per mol of the silver halide in the layer where the dye is present.

The emulsions used are summarized in Table 1.

| | | |
|---|---|---|
| 1st layer (first antihalation layer) | | |
| Black colloidal silver | silver | 0.070 |
| Gelatin | | 0.660 |
| Cpd-2 | | 0.001 |
| F-8 | | 0.001 |
| 2nd layer (second antihalation layer) | | |
| Black colloidal silver | silver | 0.090 |
| Gelatin | | 0.830 |
| F-8 | | 0.001 |
| 3rd layer (Interlayer) | | |
| Cpd-1 | | 0.086 |
| UV-2 | | 0.029 |
| UV-3 | | 0.052 |
| UV-4 | | 0.011 |
| HBS-1 | | 0.100 |
| Gelatin | | 0.580 |
| 4th layer (Low-speed red-sensitive emulsion layer) | | |
| Em-D | silver | 0.57 |
| Em-C | silver | 0.47 |
| ExC-1 | | 0.222 |
| ExC-2 | | 0.010 |
| ExC-3 | | 0.072 |
| ExC-4 | | 0.148 |
| ExC-5 | | 0.005 |
| ExC-6 | | 0.008 |
| ExC-8 | | 0.071 |
| ExC-9 | | 0.010 |
| ExS-1 | | $1.4 \times 10^{-3}$ |
| ExS-2 | | $6.0 \times 10^{-4}$ |
| ExS-3 | | $2.0 \times 10^{-5}$ |
| UV-2 | | 0.036 |
| UV-3 | | 0.067 |
| UV-4 | | 0.014 |
| Cpd-2 | | 0.010 |
| Cpd-4 | | 0.012 |
| HBS-1 | | 0.240 |
| HBS-5 | | 0.010 |
| Gelatin | | 1.630 |
| 5th layer (Medium-speed red-sensitive emulsion layer) | | |
| Em-B | silver | 0.63 |
| ExC-1 | | 0.111 |
| ExC-2 | | 0.039 |
| ExC-3 | | 0.018 |
| ExC-4 | | 0.074 |
| ExC-5 | | 0.019 |
| ExC-6 | | 0.024 |

TABLE 1

| Emulsion | Av. Equivalent circle diameter (μm) | Av. Aspect ratio | Av. Equivalent sphere diameter (μm) | Grain shape | Dislocation lines (number/grain) | Twin plane distance (μm) | Ratio of grains having an aspect ratio of 8 or more to the total projected area of grains (%) |
|---|---|---|---|---|---|---|---|
| Em-B | 1.50 | 6.0 | 0.80 | Tabular | 10 or more | 0.012 | 45 |
| Em-C | 0.85 | 7.1 | 0.51 | Tabular | 10 or more | 0.012 | 55 |
| Em-D | 0.40 | 2.7 | 0.35 | Tabular | 10 or more | 0.011 | 10 or less |
| Em-F | 2.00 | 3.0 | 0.92 | Tabular | 10 or more | 0.013 | 10 |
| Em-G | 1.60 | 7.0 | 0.79 | Tabular | 10 or more | 0.012 | 50 |
| Em-H | 0.85 | 7.1 | 0.51 | Tabular | 10 or more | 0.012 | 55 |
| Em-I | 0.58 | 3.2 | 0.45 | Tabular | 10 or more | 0.010 | 15 |
| Em-J | 2.00 | 7.0 | 0.92 | Tabular | 10 or more | 0.012 | 50 |
| Em-L | 1.25 | 4.3 | 0.89 | Tabular | 10 or more | 0.011 | 15 |
| Em-M | 0.55 | 4.6 | 0.37 | Tabular | 10 or more | 0.010 | 20 |
| Em-N | — | — | 0.19 | Cubic | — | — | 10 or less |
| Em-O | 3.10 | 10.0 | 1.65 | Tabular | 10 or more | 0.015 | 90 |
| Em-P | 2.63 | 11.4 | 1.33 | Tabular | 10 or more | 0.012 | 95 |
| Em-Q | 2.63 | 11.4 | 1.33 | Tabular | 10 or more | 0.012 | 95 |

-continued

| | | |
|---|---|---|
| ExC-8 | | 0.010 |
| ExC-9 | | 0.005 |
| ExS-1 | | $6.3 \times 10^{-4}$ |
| ExS-2 | | $2.6 \times 10^{-4}$ |
| ExS-3 | | $8.7 \times 10^{-6}$ |
| Cpd-2 | | 0.020 |
| Cpd-4 | | 0.021 |
| HBS-1 | | 0.129 |
| Gelatin | | 0.900 |

6th layer (High-speed red-sensitive emulsion layer)

| | | |
|---|---|---|
| Em-P | silver | 1.27 |
| ExC-1 | | 0.122 |
| ExC-6 | | 0.032 |
| ExC-8 | | 0.110 |
| ExC-9 | | 0.005 |
| ExC-10 | | 0.159 |
| ExS-1 | | $3.2 \times 10^{-4}$ |
| ExS-2 | | $2.6 \times 10^{-4}$ |
| ExS-3 | | $8.8 \times 10^{-6}$ |
| Cpd-2 | | 0.068 |
| Cpd-4 | | 0.015 |
| HBS-1 | | 0.440 |
| Gelatin | | 1.610 |

7th layer (Interlayer)

| | | |
|---|---|---|
| Cpd-1 | | 0.081 |
| Cpd-6 | | 0.002 |
| HBS-1 | | 0.049 |
| Poly(ethyl acrylate) latex | | 0.088 |
| Gelatin | | 0.759 |

8th layer (Layer for donating inter-layer effect to red-sensitive layer)

| | | |
|---|---|---|
| Em-J | silver | 0.40 |
| Cpd-4 | | 0.10 |
| ExM-2 | | 0.082 |
| ExM-3 | | 0.006 |
| ExM-4 | | 0.026 |
| ExY-1 | | 0.010 |
| ExY-4 | | 0.040 |
| ExC-7 | | 0.007 |
| ExS-4 | | $7.0 \times 10^{-4}$ |
| ExS-5 | | $2.5 \times 10^{-4}$ |
| HBS-1 | | 0.203 |
| HBS-3 | | 0.003 |
| HBS-5 | | 0.010 |
| Gelatin | | 0.570 |

9th layer (Low-speed green-sensitive emulsion layer)

| | | |
|---|---|---|
| Em-H | silver | 0.23 |
| Em-G | silver | 0.15 |
| Em-I | silver | 0.26 |
| ExM-2 | | 0.388 |
| ExM-3 | | 0.040 |
| ExY-1 | | 0.003 |
| ExY-3 | | 0.002 |
| ExC-7 | | 0.009 |
| ExS-5 | | $3.0 \times 10^{-4}$ |
| ExS-6 | | $8.4 \times 10^{-5}$ |
| ExS-7 | | $1.1 \times 10^{-4}$ |
| ExS-8 | | $4.5 \times 10^{-4}$ |
| ExS-9 | | $1.3 \times 10^{-4}$ |
| HBS-1 | | 0.337 |
| HBS-3 | | 0.018 |
| HBS-4 | | 0.260 |
| HBS-5 | | 0.110 |
| Cpd-5 | | 0.010 |
| Gelatin | | 1.470 |

10th layer (Medium-speed green-sensitive emulsion layer)

| | | |
|---|---|---|
| Em-F | silver | 0.42 |
| ExM-2 | | 0.084 |
| ExM-3 | | 0.012 |
| ExM-4 | | 0.005 |
| ExY-3 | | 0.002 |
| ExC-6 | | 0.003 |
| ExC-7 | | 0.007 |

-continued

| | | |
|---|---|---|
| ExC-8 | | 0.008 |
| ExS-7 | | $1.0 \times 10^{-4}$ |
| ExS-8 | | $7.1 \times 10^{-4}$ |
| ExS-9 | | $2.0 \times 10^{-4}$ |
| HBS-1 | | 0.096 |
| HBS-3 | | 0.002 |
| HBS-5 | | 0.002 |
| Cpd-5 | | 0.004 |
| Gelatin | | 0.382 |

11th layer (High-speed green-sensitive emulsion layer)

| | | |
|---|---|---|
| Em-Q | silver | 0.95 |
| ExC-6 | | 0.002 |
| ExC-8 | | 0.010 |
| ExM-1 | | 0.014 |
| ExM-2 | | 0.023 |
| ExM-3 | | 0.023 |
| ExM-4 | | 0.005 |
| ExM-5 | | 0.040 |
| ExY-3 | | 0.003 |
| ExS-7 | | $8.4 \times 10^{-4}$ |
| ExS-8 | | $5.9 \times 10^{-4}$ |
| ExS-9 | | $1.7 \times 10^{-4}$ |
| Cpd-3 | | 0.004 |
| Cpd-4 | | 0.007 |
| Cpd-5 | | 0.010 |
| HBS-1 | | 0.259 |
| HBS-5 | | 0.020 |
| Poly(ethyl acrylate) latex | | 0.099 |
| Gelatin | | 0.781 |

12th layer (Yellow filter layer)

| | | |
|---|---|---|
| Cpd-1 | | 0.088 |
| Solid disperse dye ExF-2 | | 0.051 |
| Solid disperse dye ExF-8 | | 0.010 |
| HBS-1 | | 0.049 |
| Gelatin | | 0.593 |

13th layer (Low-speed blue-sensitive emulsion layer)

| | | |
|---|---|---|
| Em-N | silver | 0.12 |
| Em-M | silver | 0.09 |
| Em-L | silver | 0.50 |
| ExC-1 | | 0.024 |
| ExC-7 | | 0.011 |
| ExY-1 | | 0.002 |
| ExY-2 | | 0.956 |
| ExY-4 | | 0.091 |
| ExS-10 | | $8.5 \times 10^{-5}$ |
| ExS-11 | | $6.4 \times 10^{-4}$ |
| ExS-12 | | $8.5 \times 10^{-5}$ |
| ExS-13 | | $5.0 \times 10^{-4}$ |
| Cpd-2 | | 0.037 |
| Cpd-3 | | 0.004 |
| HBS-1 | | 0.372 |
| HBS-5 | | 0.047 |
| Gelatin | | 2.201 |

14th layer (High-speed blue-sensitive emulsion layer)

| | | |
|---|---|---|
| Em-O | silver | 0.22 |
| ExY-2 | | 0.235 |
| ExY-4 | | 0.018 |
| ExS-10 | | $1.5 \times 10^{-4}$ |
| ExS-13 | | $2.0 \times 10^{-4}$ |
| Cpd-2 | | 0.075 |
| Cpd-3 | | 0.001 |
| HBS-1 | | 0.087 |
| Gelatin | | 1.156 |

15th layer (First protective layer)

| | | |
|---|---|---|
| 0.07 $\mu$m (equivalent sphere diameter) silver iodobromide emulsion | silver | 0.28 |
| UV-1 | | 0.358 |
| UV-2 | | 0.179 |
| UV-3 | | 0.254 |
| UV-4 | | 0.025 |
| F-11 | | 0.0081 |
| SC-1 | | 0.078 |
| HBS-1 | | 0.175 |

-continued

| | | |
|---|---|---|
| HBS-4 | | 0.050 |
| Gelatin | | 2.231 |
| 16th layer (Second protective layer) | | |
| H-1 | | 0.400 |
| B-1 (diameter 1.7 μm) | 0.050 | |
| B-2 (diameter 1.7 μm) | 0.150 | |
| B-3 | | 0.050 |
| SC-1 | | 0.200 |
| Gelatin | | 0.711 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-17, lead salt, platinum salt, iridium salt and rhodium salt. Preparation of Dispersion of Organic Solid Disperse Dye ExF-2 for the 12th layer was dispersed by the following method.

| | |
|---|---|
| Wet cake of ExF-2 (containing 17.6% by weight of water) | 2.800 kg |
| Sodium octylphenyldiethoxymethanesulfonate (31%-by-weight aqueous solution) | 0.376 kg |
| F-15 (7%-by-weight aqueous solution) | 0.011 kg |
| Water | 4.020 kg |
| Total (Adjusted to pH 7.2 using NaOH) | 7.210 kg |

The slurry having the above composition was agitated with a dissolver to be roughly dispersed and then further dispersed using an agitator mill LMK-4 at a peripheral speed of 10 m/s, a discharge rate of 0.6 kg/min and a zirconia beads (0.3 mm in size) with a filling content of 80% until the absorbance ratio of the dispersion liquid became 0.29. Thus, a solid fine grain dispersion was obtained. The dye fine grains had an average diameter of 0.29 μm. A solid dispersion of ExF-8 was obtained in the same manner. The dye fine grains had an average diameter of 0.49 μm.

Comparative sample 002 was prepared by making the following modifications to comparative sample 001.

Colored couplers ExC-2 and -5 and ExM-1 and -3 contained in the 4th, 5th, 8th, 9th, 10th and 11th layers were removed and they were replaced by the following couplers.

ExC-2 was replaced by ExC-3 in an amount of 45% by weight of ExC-2.

ExC-5 was replaced by ExC-3 in an amount of 80% by weight of ExC-5.

ExM-1 was replaced by ExM-2 in the same amount as ExM-1.

ExM-3 was replaced by ExM-2 in an amount of 80% by weight of ExM-3.

Further, comparative samples 003 and 004 and samples 005 and 006 according to the present invention were prepared by adding compounds (water-soluble dyes) capable of absorbing a light within the spectrally sensitizing region of the emulsion, recited below, to the 15th layers of comparative samples 001 and 002 in the coating amounts (g/m$^2$) shown in Table a below.

TABLE a

| | Comp. Sample 003 | Inv. Sample 005 | Comp. Sample 004 | Inv. Sample 006 |
|---|---|---|---|---|
| ExF-5 | 0.011 | | 0.022 | |
| ExF-6 | 0.0043 | | 0.0086 | |
| ExF-7 | 0.021 | | 0.042 | |

Further, comparative sample 007 and sample 008 according to the present invention were prepared by adding compounds dyes recited below to the 15th layers of comparative samples 001 and 002 in the coating amounts (g/m$^2$) shown in Table b below.

TABLE b

| | Comp. 007 | Inv. 008 |
|---|---|---|
| II-5 | 0.025 | 0.025 |
| III-2 | 0.014 | 0.014 |
| III-3 | 0.009 | 0.009 |

In the preparation of Sample 001 to 008, the coating solutions for all the layers were prepared while controlling the temperatures thereof at 45° C., then, coated the solutions after a predetermined time.

Further, Samples 101 to 106 and Samples 201 to 206 were prepared by changing the preparation temperature of Samples 001 to 006 to 40° C. and 50° C., respectively.

Compounds used for the emulsion preparation and those used in each layer in the coated sample preparation are set forth below.

ExS-1

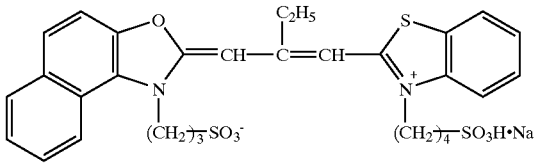

ExS-2

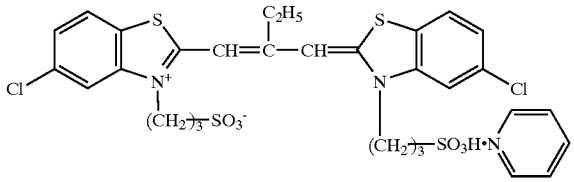

-continued
ExS-3
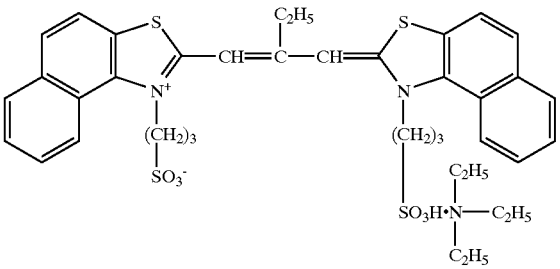
ExS-4
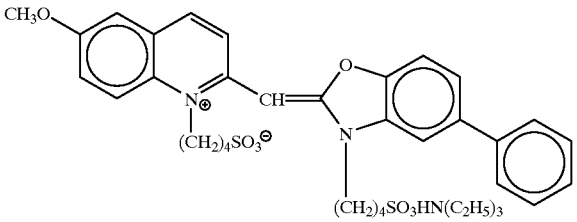
ExS-5
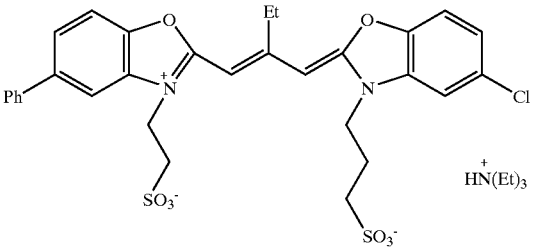
ExS-6
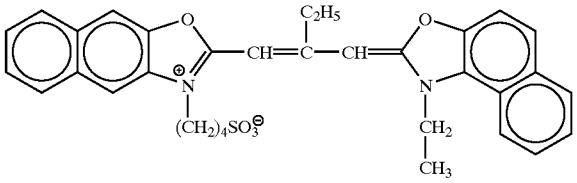
ExS-7
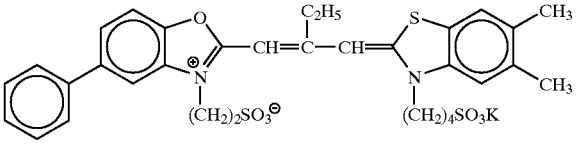
ExS-8
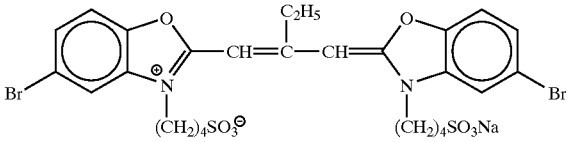
ExS-9
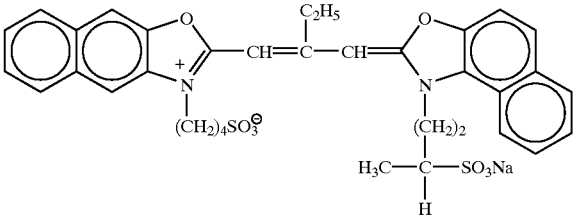
ExS-10
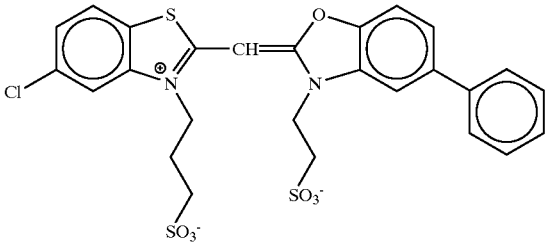
ExS-11
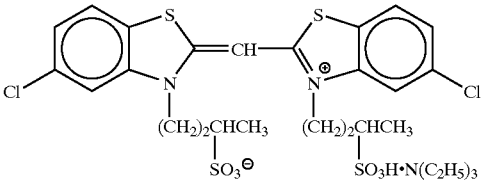
ExS-12
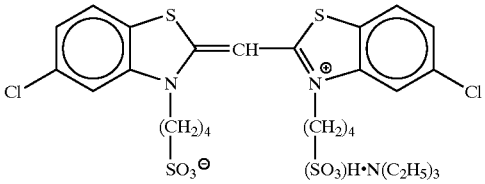
ExS-13
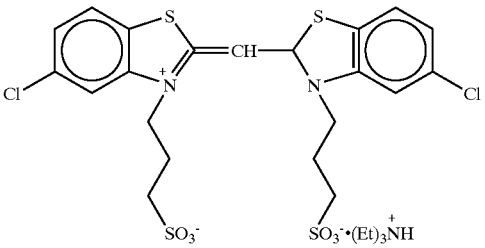
ExC-1
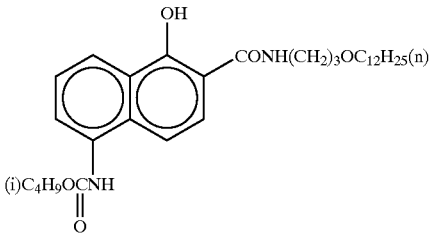

-continued
ExC-2
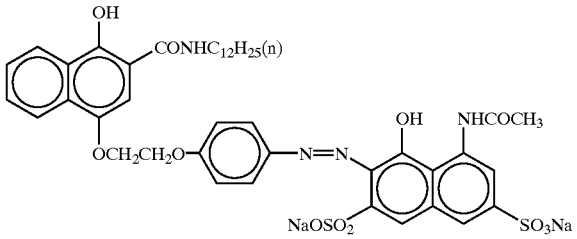
ExC-3
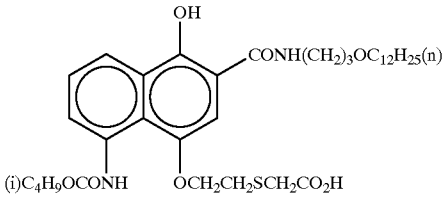
ExC-4
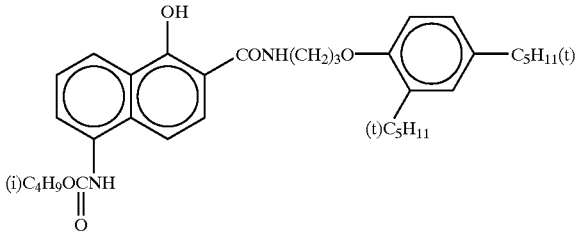
ExC-5
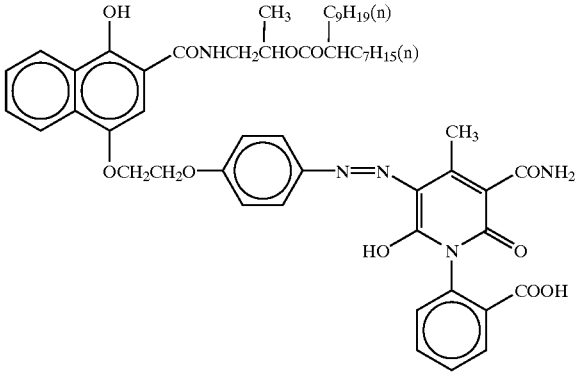
ExC-6
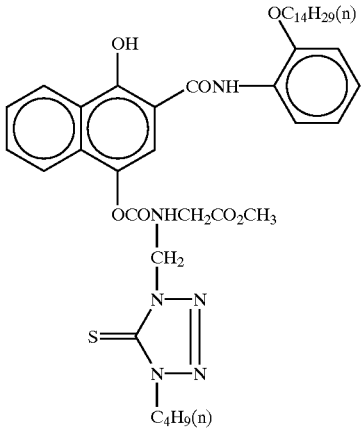
ExM-1
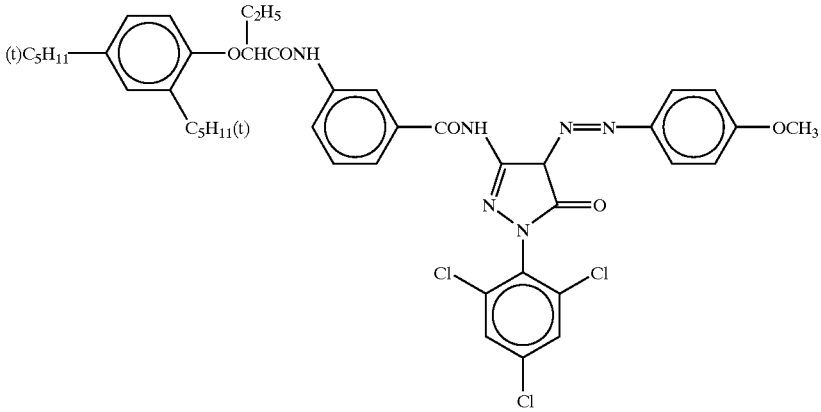

-continued
ExM-2
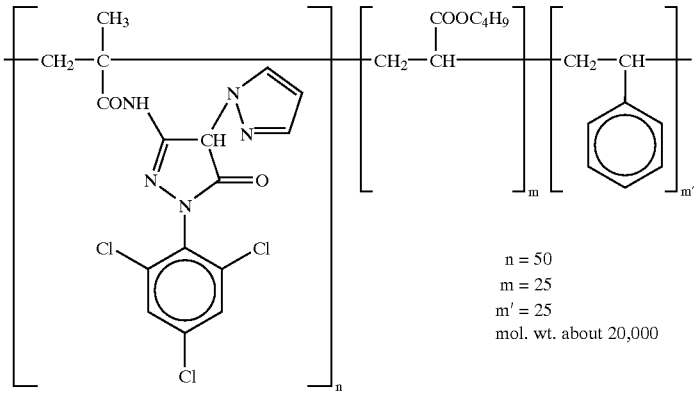
n = 50
m = 25
m′ = 25
mol. wt. about 20,000
ExM-3
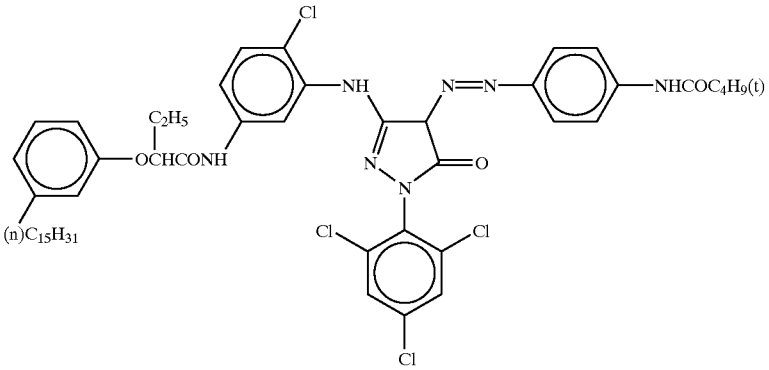
ExM-4
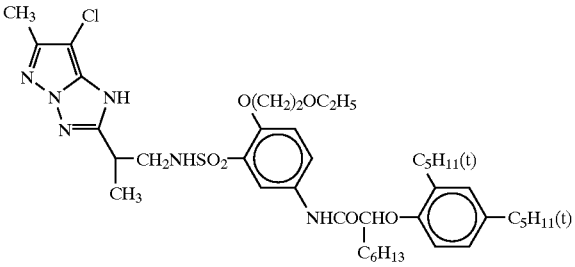
ExM-5
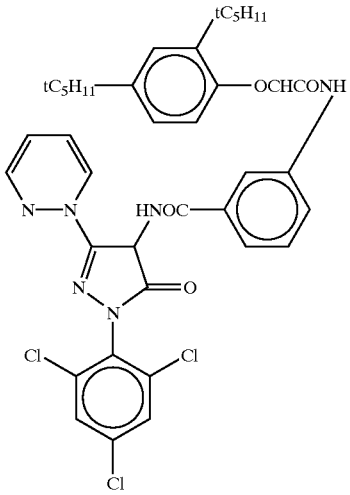
ExY-1
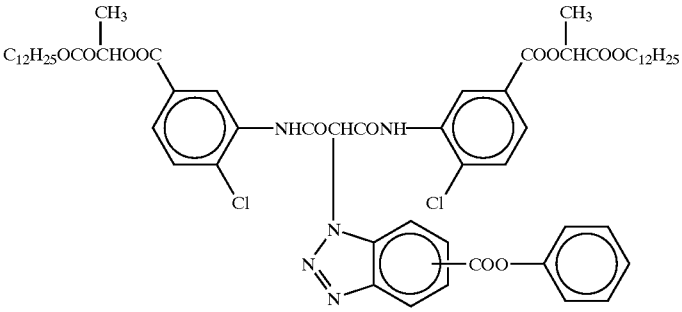

-continued
ExY-2
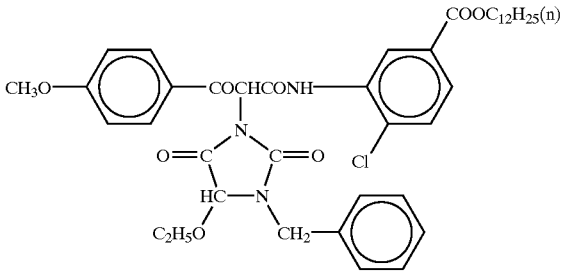
ExY-3
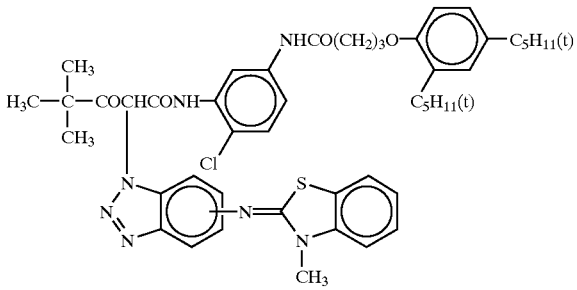
ExY-4
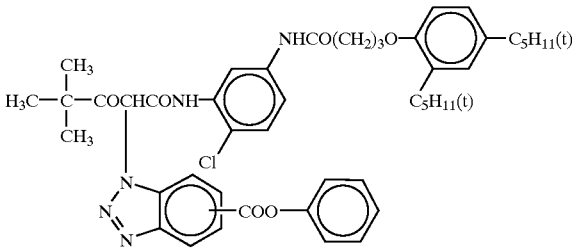
Cpd-1
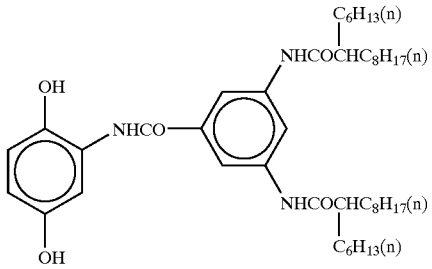
Cpd-2
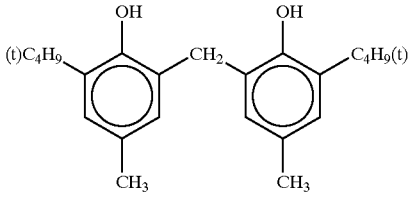
Cpd-3
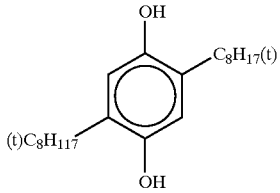
Cpd-4
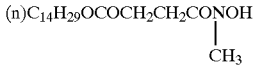
Cpd-5
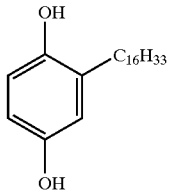
Cpd-6
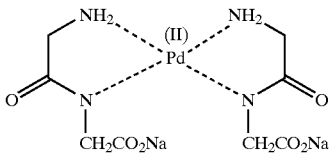
UV-1
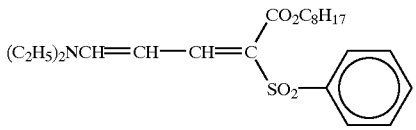
UV-2
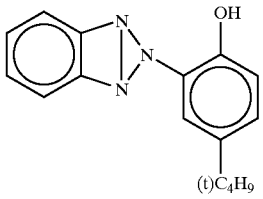
UV-3
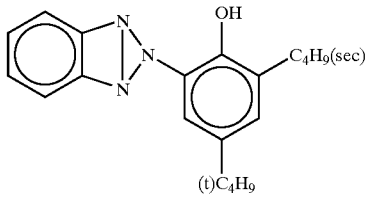
UV-4
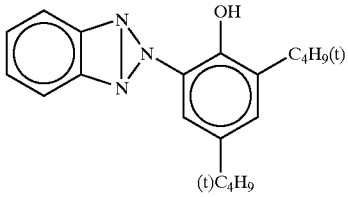
B-1
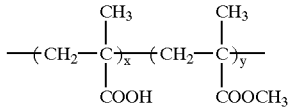
x/y = 10/90 (wt. ratio)
Av. mol. wt.: about 35,000

-continued
B-2
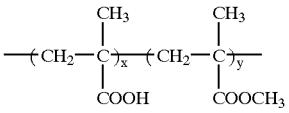
x/y = 40/60 (wt. ratio)
Av. mol. wt.: about 20,000
B-3
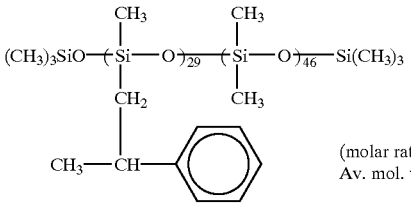
(molar ratio)
Av. mol. wt.: about 8,000
H-1
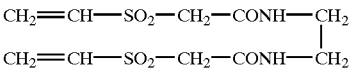
SC-1
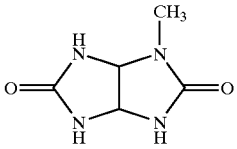
HBS-1
Tricresyl phosphate
HBS-2
Di-n-butyl phthalate
HBS-3
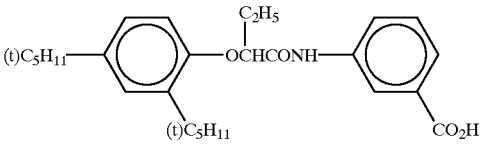
HBS-4
Tri(2-ethylhexyl) phosphate
HBS-5
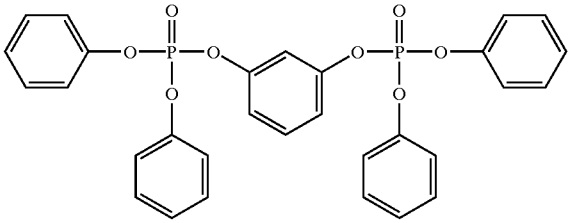
F-1
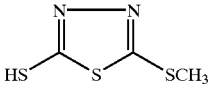
F-2
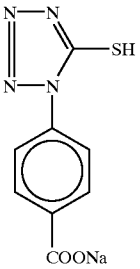
F-3
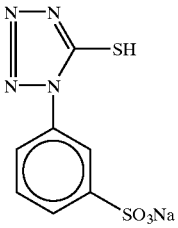
F-4
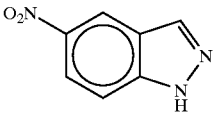
F-5
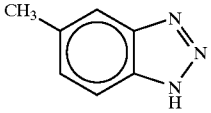
F-6
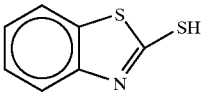
F-7
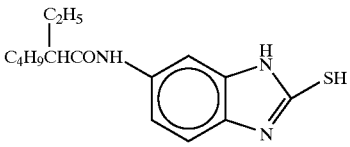
F-8
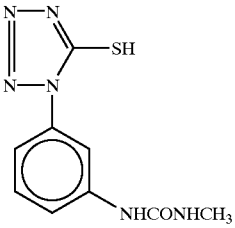
F-9
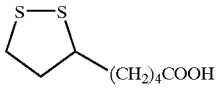

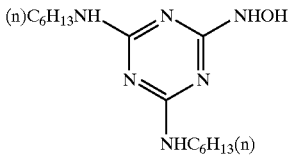
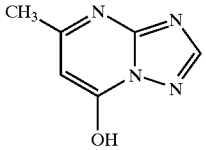
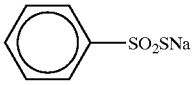
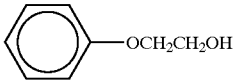
$C_8F_{17}SO_2NHCH_2CH_2CH_2OCH_2CH_2\overset{\oplus}{N}(CH_3)_3$
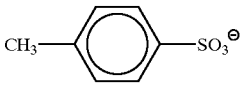
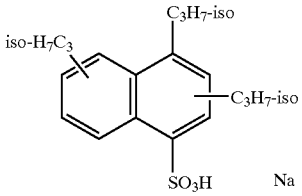
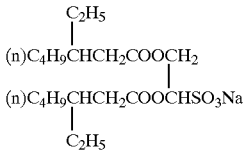
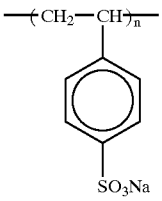
Av. mol. wt.: about 750,000
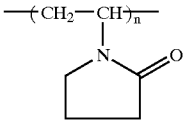
Av. mol. wt.: about 10,000
-continued
F-10
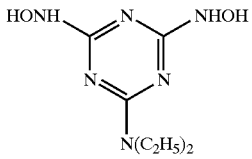
F-11
F-12
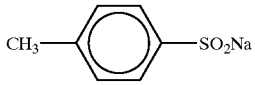
F-13
F-14
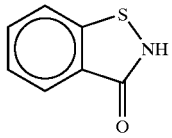
F-15
F-16
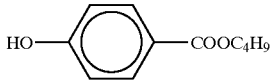
F-17
W-1
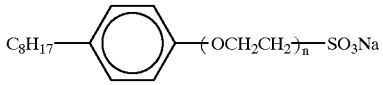
n = 2–4
W-2
W-3
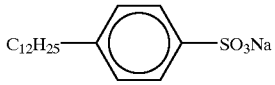
W-4
W-5
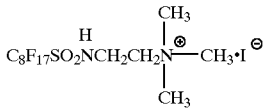
W-6
B-4
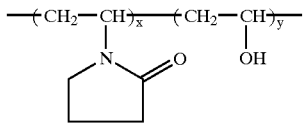
x/y = 70/30 (wt. ratio)
Av. mol. wt.: about 17,000
B-5
B-6
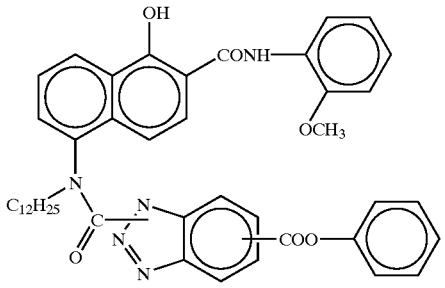
ExC-7

-continued

ExC-8

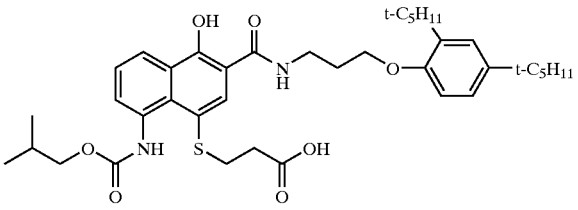

ExC-9

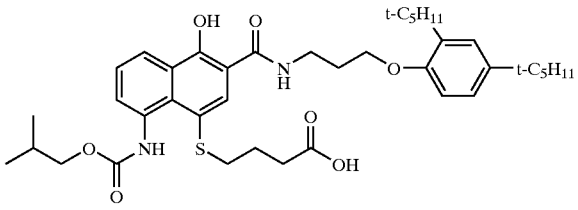

ExC-10

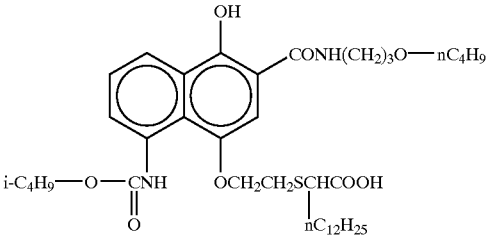

ExF-2

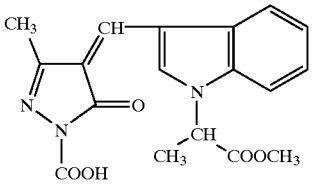

ExF-5

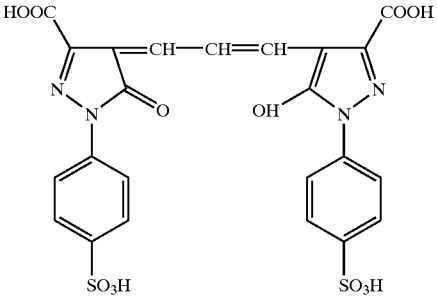

ExF-6

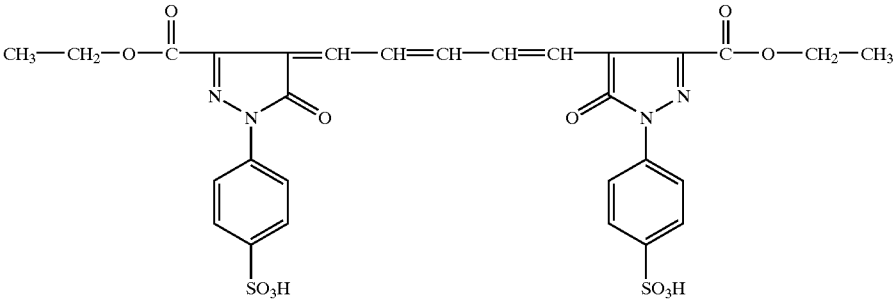

ExF-7

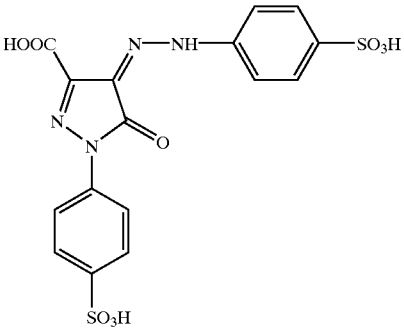

ExF-8

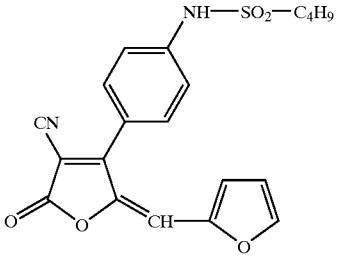

The above samples 001 through 008 were exposed for 1/100 second through a SC-39 gelatin filter manufactured by Fuji Photo Film Co., Ltd. and a continuous wedge with the use of white light (light temperature: 4800 K) and then were subjected to development processing described below. Dmin and sensitivity (the logarithm of the reciprocal of the exposure amount giving (Dmin+a density of 0.2)) were determined. The sensitivity is indicated using a relative value obtained when the sensitivity of sample 001 is taken as 0 (zero).

For measurement of MTF, the same processing as that described above was conducted after exposing the samples to a light through an MTF chart. The MTF value was indicated using a relative value obtained when sample 001measured at 10 cycles/mm of a density giving (Dmin+

0.2) is taken as 100. The greater than 100the MTF value, the better the sharpness.

Using samples 001to 008, prints for test photographing of 50 scenes were prepared with a digital printer. The finished condition was rated on a scale including the three levels, A (excellent), B (regular) and C (poor). For each print, printing was conducted under conditions where the best finish can be achieved.

Further, samples 101to 106and 201to 206were exposed for 1/100 second through a SC-39 gelatin filter manufactured by Fuji Photo Film Co., Ltd. and a continuous wedge with the use of white light (light temperature: 4800 K) and then were subjected to development processing described below. Dmin and sensitivity (the logarithm of the reciprocal of the exposure amount giving (Dmin+a density of 0.2)) were determined. The absolute value of the differences between the greatest and least values of Dmin's was calculated with respect to each of B, G and R layers of samples 001, 101 and 201. The absolute values of B, G and R layers thus calculated were summed up to obtain ΔDmin(001). In the same manner, ΔDmin(002) to ΔDmin(006) were calculated using samples 002 to 006, 102 to 106, and 202 to 206. The smaller ΔDmin, the better the production stability.

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5L |
| Bleaching | 50 sec | 38.0° C. | 5 mL | 5L |
| Fixing (1) | 50 sec | 38.0° C. | — | 5L |
| Fixing (2) | 50 sec | 38.0° C. | 8 mL | 5L |
| Washing | 30 sec | 38.0° C. | 17 mL | 3L |
| Stabilization (1) | 20 sec | 38.0° C. | — | 3L |
| Stabilization (2) | 20 sec | 38.0° C. | 15 mL | 3L |
| Drying | 1 min 30 sec | 60.0° C. | | |

*The replenishment rate was per 1.1 m of a 35-mm wide sensitized material (equivalent to one roll of 24 Ex)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100cm$^2$ and 120 cm$^2$, respectively, and the opening areas for other solutions were about 100cm$^2$.

The compositions of the processing solutions are presented below.

| | <Tank solution> (g) | <Replenisher> (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0L | 1.0L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0L | 1.0L |
| pH (adjusted by ammonia water) | 4.6 | 4.0 |
| (Fixer (1) Tank solution) | | |
| A 5:95 mixture (v/v) of the above bleaching tank solution and the below fixing tank solution pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1.0L | 1.0L |
| pH (adjusted by ammonia water and acetic acid) | 7.4 | 7.45 |

Washing water

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0L |
| pH | 8.5 |

TABLE 2

| | Sensitivity | | | MTF | | | DMIN density (abs) | | | Evaluation | Production stability |
|---|---|---|---|---|---|---|---|---|---|---|---|
| Sample | B | G | R | B | G | R | B | G | R | of print | (Δ dmin) |
| 001 Comp. | 0 | 0 | 0 | 100 | 100 | 100 | 0.84 | 0.56 | 0.25 | B | 0.05 |
| 002 Comp. | 0.16 | 0.16 | 0.16 | 88 | 95 | 87 | 0.32 | 0.38 | 0.23 | B | 0.02 |
| 003 Comp. | −0.07 | −0.07 | −0.07 | 105 | 105 | 105 | 0.84 | 0.56 | 0.25 | B | 0.06 |
| 004 Comp. | −0.15 | −0.15 | −0.15 | 110 | 110 | 110 | 0.84 | 0.56 | 0.25 | B | 0.08 |
| 005 Inv. | 0.08 | 0.08 | 0.08 | 97 | 103 | 96 | 0.32 | 0.38 | 0.23 | A | 0.00 |
| 006 Inv. | 0 | 0 | 0 | 107 | 108 | 107 | 0.32 | 0.38 | 0.23 | A | 0.00 |
| 007 Comp. | −0.15 | −0.15 | −0.15 | 110 | 110 | 110 | 0.84 | 0.56 | 0.25 | A | — |
| 008 Inv. | 0.02 | 0.02 | 0.02 | 105 | 106 | 105 | 0.32 | 0.38 | 0.23 | A | — |

The results for samples 001to 006 summarized in Table 2 clearly show that the effect on improvement in MTF resulting from the increase of the amount of a dye is exhibited particularly remarkably for the systems using no colored couplers. Only when the requirements of the present invention are satisfied, a sample of a high speed, a good MTF performance and a low Dmin can be obtained. The lower the Dmin density, the more the quantity of light necessary during reading with a scanner is reduced. Further, the results of printing were very good when the samples according to the present invention were used. In addition, as is apparent from the results of Samples 001, 002, 007 and 008, the same results were attained when a dye that changes, during a development processing, into a compound that absorbs substantially no light within the spectrally sensitizing region of the spectrally sensitized emulsion, was used. Further, as is apparent from the results of samples 001to 006, the samples of the present invention were excellent in production stability, which was unexpected.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color negative photographic lightsensitive material comprising, on a support, at least one blue-sensitive silver halide emulsion layer, at least one green-sensitive silver halide emulsion layer and at least one red-sensitive silver halide emulsion layer, wherein the total coating amount of colored couplers in the light-sensitive material is less than 0.05 mMol/$m^2$, and the lightsensitive material contains at least one spectrally sensitized silver halide emulsion and a compound capable of absorbing light within the spectrally sensitizing region of the spectrally sensitized silver halide emulsion, and capable of reducing the sensitivity of the spectrally sensitized silver halide emulsion by at least 0.05 LogE.

2. The silver halide color negative photographic lightsensitive material according to claim 1, wherein the compound is capable of reducing the sensitivity of the spectrally sensitized silver halide emulsion by at least 0.10 LogE.

3. The silver halide color negative photographic lightsensitive material according to claim 1, wherein the coating amount of the colored couplers is less than 0.02 mMol/$m^2$.

4. The silver halide color negative photographic lightsensitive material according to claim 1, wherein the compound is capable of flowing out of the light-sensitive material during development process of the lightsensitive material.

5. The silver halide color negative photographic lightsensitive material according to claim 1, wherein the compound is capable of changing, during the development process of the lightsensitive material, into a compound absorbing substantially no light within the spectrally sensitizing region of the spectrally sensitized silver halide emulsion.

6. The silver halide color negative photographic lightsensitive material according to claim 2, wherein the coating amount of the colored couplers is less than 0.02 mMol/$m^2$.

7. The silver halide color negative photographic lightsensitive material according to claim 2, wherein the compound is capable of flowing out of the lightsensitive material during development process of the lightsensitive material.

8. The silver halide color negative photographic lightsensitive material according to claim 2, wherein the compound is capable of changing, during the development process of the lightsensitive material, into a compound absorbing substantially no light within the spectrally sensitizing region of the spectrally sensitized silver halide emulsion.

9. The silver halide color negative photographic lightsensitive material according to claim 3, wherein the compound is capable of flowing out of the lightsensitive material during development process of the lightsensitive material.

10. The silver halide color negative photographic lightsensitive material according to claim 3, wherein the compound is capable of changing, during the development process of the lightsensitive material, into a compound absorbing substantially no light within the spectrally sensitizing region of the spectrally sensitized silver halide emulsion.

11. The silver halide color negative photographic lightsensitive material according to claim 6, wherein the compound is capable of flowing out of the lightsensitive material during development process of the lightsensitive material.

12. The silver halide color negative photographic lightsensitive material according to claim 6, wherein the compound is capable of changing, during the development process of the lightsensitive material, into a compound absorbing substantially no light within the spectrally sensitizing region of the spectrally sensitized silver halide emulsion.

13. An image processing method comprising:

reading image information signals after developing a silver halide color negative photographic lightsensitive material comprising, on a support, at least one blue-sensitive silver halide emulsion layer, at least one green-sensitive silver halide emulsion layer and at least one red-sensitive silver halide emulsion layer, wherein the total coating amount of colored couplers in the lightsensitive material is less than 0.05 mMol/$m^2$, and the lightsensitive material contains at least one spectrally sensitized silver halide emulsion and a compound capable of absorbing light within the spectrally sensitizing region of the spectrally sensitized silver halide emulsion, capable of reducing the sensitivity of the spectrally sensitized silver halide emulsion by at least 0.05 LogE, and capable of flowing out of the lightsensitive material during development process of the lightsensitive material; and regulating the image information signals to output an image.

14. The image processing method according to claim 13, wherein the coating amount of the colored couplers is less than 0.02 mMol/$m^2$.

15. The image processing method according to claim 13, wherein the compound is capable of reducing the sensitivity of the spectrally sensitized silver halide emulsion by at least 0.10 LogE.

16. The image processing method according to claim 13, wherein the compound is capable of reducing the sensitivity of the spectrally sensitized silver halide emulsion by at least 0.10 LogE; and the coating amount of the colored couplers is less than 0.02 mMol/$m^2$.

17. An image processing method comprising:

reading image information signals after developing a silver halide color negative photographic lightsensitive material comprising, on a support, at least one blue-sensitive silver halide emulsion layer, at least one green-sensitive silver halide emulsion layer and at least one red-sensitive silver halide emulsion layer, wherein the total coating amount of colored couplers in the lightsensitive material is less than 0.05 mMol/$m^2$, and the lightsensitive material contains at least one spectrally sensitized silver halide emulsion and a compound capable of absorbing light within the spectrally sensitizing region of the spectrally sensitized silver halide emulsion, capable of reducing the sensitivity of the spectrally sensitized silver halide emulsion by at least 0.05 LogE, and capable of changing, during the development process of the lightsensitive material, into a compound absorbing substantially no light within the spectrally sensitizing region of the spectrally sensitized silver halide emulsion; and regulating the image information signals to output an image.

18. The image processing method according to claim 17, wherein the coating amount of the colored couplers is less than 0.02 mMol/$m^2$.

19. The image processing method according to claim 17, wherein the compound is capable of reducing the sensitivity of the spectrally sensitized silver halide emulsion by at least 0.10 LogE.

20. The image processing method according to claim 17, wherein the compound is capable of reducing the sensitivity of the spectrally sensitized silver halide emulsion by at least 0.10 LogE; and the coating amount of the colored couplers is less than 0.02 mMol/$m^2$.

* * * * *